US009043216B2

(12) United States Patent
Bayer et al.

(10) Patent No.: US 9,043,216 B2
(45) Date of Patent: May 26, 2015

(54) AUDIO SIGNAL DECODER, TIME WARP CONTOUR DATA PROVIDER, METHOD AND COMPUTER PROGRAM

(75) Inventors: Stefan Bayer, Nuremberg (DE); Sascha Disch, Fuerth (DE); Ralf Geiger, Erlangen (DE); Guillaume Fuchs, Nuremberg (DE); Max Neuendorf, Nuremberg (DE); Gerald Schuller, Erfurt (DE); Bernd Edler, Hannover (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 1050 days.

(21) Appl. No.: 12/935,718

(22) PCT Filed: Jul. 1, 2009

(86) PCT No.: PCT/EP2009/004757

§ 371 (c)(1),
(2), (4) Date: Jan. 21, 2011

(87) PCT Pub. No.: WO2010/003582

PCT Pub. Date: Jan. 14, 2010

(65) Prior Publication Data

US 2011/0106542 A1 May 5, 2011

Related U.S. Application Data

(60) Provisional application No. 61/079,873, filed on Jul. 11, 2008, provisional application No. 61/103,820, filed on Oct. 8, 2008.

(51) Int. Cl.
*G10L 21/04* (2013.01)
*G10L 19/00* (2013.01)
(Continued)

(52) U.S. Cl.
CPC ..... *G10L 21/04* (2013.01); *G10L 19/0212* (2013.01); *G10L 19/022* (2013.01)

(58) Field of Classification Search
CPC ..... G10L 19/008; G10L 19/24; G10L 21/04; G10L 19/0017; G10L 15/12; G10L 15/00; G10L 2015/085; G10L 19/00; G10L 25/27; G10L 21/01; G10L 15/10; G10L 15/063; G11B 20/10527; G11B 27/005; H05K 999/99; G06K 9/6206; H04S 3/02
USPC ..... 704/500, 503, 504, E15.016, E19.001, 704/E21.016, E21.017, E21.018, 241; 381/22
See application file for complete search history.

(56) References Cited

U.S. PATENT DOCUMENTS 5,054,075 A 10/1991 Hong et al.
5,835,889 A 11/1998 Kapanen
(Continued)

FOREIGN PATENT DOCUMENTS

CN 1408146 A 4/2003
CN 101025918 A 8/2007
(Continued)

OTHER PUBLICATIONS

"eX-CELP"; Apr. 2000; 3GPP2-Drafts, 2500 Wilson Boulevard, Suite 300, Arlington, Virginia 22201 USA, pp. 1-13, XP040353007 Seattle, WA p. 7, line 1—last line; figures 1,2.
(Continued)

*Primary Examiner* — Brian Albertalli
(74) *Attorney, Agent, or Firm* — Michael A. Glenn; Perkins Coie LLP

(57) ABSTRACT

An audio signal decoder has a time warp contour calculator, a time warp contour data rescaler and a warp decoder. The time warp contour calculator is configured to generate time warp contour data repeatedly restarting from a predetermined time warp contour start value, based on time warp contour evolution information describing a temporal evolution of the time warp contour. The time warp contour data rescaler is configured to rescale at least a portion of the time warp contour data such that a discontinuity at a restart is avoided, reduced or eliminated in a rescaled version of the time warp contour. The warp decoder is configured to provide the decoded audio signal representation, based on an encoded audio signal representation and using the rescaled version of the time warp contour.

17 Claims, 38 Drawing Sheets

(51) Int. Cl.

| | |
|---|---|
| *G10L 19/02* | (2013.01) |
| *G10L 19/022* | (2013.01) |

(56) References Cited

U.S. PATENT DOCUMENTS

| | | | | |
|---|---|---|---|---|
| 6,058,362 | A | 5/2000 | Malvar | |
| 6,122,618 | A | 9/2000 | Park | |
| 6,223,151 | B1 | 4/2001 | Kleijn et al. | |
| 6,366,880 | B1 | 4/2002 | Ashley | |
| 6,424,938 | B1 | 7/2002 | Johansson et al. | |
| 6,449,590 | B1 | 9/2002 | Gao | |
| 6,453,285 | B1 | 9/2002 | Anderson et al. | |
| 6,691,084 | B2 | 2/2004 | Manjunath et al. | |
| 6,850,884 | B2 | 2/2005 | Gao et al. | |
| 6,925,435 | B1 | 8/2005 | Gao | |
| 6,978,241 | B1 | 12/2005 | Sluijter et al. | |
| 7,024,358 | B2 | 4/2006 | Shlomot et al. | |
| 7,047,185 | B1 | 5/2006 | Younes et al. | |
| 7,146,324 | B2 * | 12/2006 | Den Brinker et al. | 704/500 |
| 7,260,522 | B2 | 8/2007 | Gao et al. | |
| 7,286,980 | B2 | 10/2007 | Wang et al. | |
| 7,366,658 | B2 | 4/2008 | Moogi et al. | |
| 7,412,379 | B2 | 8/2008 | Taori et al. | |
| 7,454,330 | B1 | 11/2008 | Nishiguchi et al. | |
| 7,457,757 | B1 | 11/2008 | McNeill et al. | |
| 7,720,677 | B2 | 5/2010 | Villemoes | |
| 8,239,190 | B2 | 8/2012 | Kapoor | |
| 2003/0065509 | A1 | 4/2003 | Walker | |
| 2003/0200081 | A1 | 10/2003 | Wada et al. | |
| 2003/0233234 | A1 | 12/2003 | Truman et al. | |
| 2005/0251387 | A1 | 11/2005 | Jelinek et al. | |
| 2005/0267746 | A1 | 12/2005 | Jelinek et al. | |
| 2006/0282263 | A1 * | 12/2006 | Vos et al. | 704/223 |
| 2007/0100607 | A1 | 5/2007 | Villemoes | |
| 2008/0004869 | A1 | 1/2008 | Herre et al. | |
| 2008/0312914 | A1 * | 12/2008 | Rajendran et al. | 704/207 |
| 2010/0046759 | A1 | 2/2010 | Pang et al. | |
| 2010/0241433 | A1 | 9/2010 | Herre et al. | |
| 2011/0029317 | A1 | 2/2011 | Chen et al. | |
| 2011/0158415 | A1 | 6/2011 | Bayer et al. | |
| 2011/0161088 | A1 | 6/2011 | Bayer et al. | |
| 2011/0178795 | A1 | 7/2011 | Bayer et al. | |
| 2011/0268279 | A1 | 11/2011 | Ishikawa et al. | |

FOREIGN PATENT DOCUMENTS

| | | | |
|---|---|---|---|
| EP | 1035242 | | 9/2000 |
| EP | 1271417 | | 1/2003 |
| EP | 1632934 | A1 | 3/2006 |
| EP | 1758101 | | 2/2007 |
| EP | 1807825 | | 7/2007 |
| JP | H07-084597 | | 9/1993 |
| JP | 5297891 | | 11/1993 |
| JP | 2003122400 | | 4/2003 |
| JP | 2005-530205 | A | 10/2005 |
| JP | 2005-530206 | A | 10/2005 |
| JP | 2006079813 | | 3/2006 |
| JP | 2006293230 | | 10/2006 |
| JP | 2007051548 | | 3/2007 |
| JP | 2008529078 | | 7/2008 |
| JP | 2009515207 | | 4/2009 |
| JP | 2009-541802 | A | 11/2009 |
| RU | 2002110441 | | 9/2000 |
| RU | 2158446 | C2 | 10/2000 |
| RU | 2194361 | C2 | 12/2002 |
| RU | 2233010 | C2 | 7/2004 |
| RU | 2005113877 | | 10/2005 |
| RU | 2316059 | | 1/2008 |
| TW | I294107 | | 4/1995 |
| TW | 200809771 | | 6/1996 |
| TW | 200822062 | | 8/1996 |
| TW | 444187 | | 7/2001 |
| WO | 03/107328 | A1 | 12/2003 |
| WO | 03/107329 | A1 | 12/2003 |
| WO | WO-2006079813 | | 8/2006 |
| WO | WO 2006/113921 | A1 | 10/2006 |
| WO | WO 2007/051548 | A1 | 5/2007 |
| WO | WO-2007051548 | | 5/2007 |
| WO | 2008/000316 | A1 | 1/2008 |
| WO | WO-2008000316 | | 1/2008 |
| WO | WO 2009/121499 | A1 | 10/2009 |
| WO | WO2010/003581 | A1 | 1/2010 |
| WO | WO2010/003582 | A1 | 1/2010 |
| WO | WO2010/003583 | A1 | 1/2010 |

OTHER PUBLICATIONS

Chen Shuixian et al. "A Window Switching Algorithm for AVS Audio Coding"; Sep. 2007; IEEE International Conference on Wireless Communications, Networking and Mobile Computing (WICOM 2007): Piscataway, NJ, USA, pp. 2889-2892, XP031261889 ISBN: 978-1-4244-1311-9 p. 2890, left-hand column, line 1—p. 2891, right-hand column, last line; figure 2.

Fielder L D et al: "AC-2 and AC-3: Low-Complexity Transform-Based Audio Coding"; Jan. 1996; Collected Papers on Digital Audio Bit-Rate Reduction, pp. 54-72, XP009045603 p. 60, line 11, p. 61 line 16, paragraph r; figures 3, 4; p. 63, line 20-p. 64, line 8; p. 66, line 4—line 37; p. 67, line 30—line 40.

Generic Coding of Moving Pictures and Associated Audio: Advanced Audio Coding, International Standard 13818-7, ISO/IECJTC1/SC29/WG11 Moving Pictures Expert Group, Apr. 1997, 108 pages.

Herre J et al: "Enhancing the Performance of Perceptual Audio Coders by Using Temporal Noise Shaping /TNS)" Preprints of Papers Presented at the AES Convention, Nov. 1996, pp. 1-24, XP002102636 p. 7, line 9—last line; table 1.

Herre J et al: "Extending the MPEG-4 AAC Codec by Perceptual Noise Substitution"; Jan. 1998; Preprints of Papers Presented at the AES Convention,pp. 1-14, XP008006769 "1. The Perceptual Noise Substitution Technique"; Fig.3.

Huimin Yang et al; "Pitch synchronous modulated lapped transform of the linear prediction residual of speech"; Oct. 1998; Proceedings of the Conference on Signal Processing, pp. 591-594, XP002115036 paragraphs 2, 3, figure 2.

Krishnan V. et al: "EVRC—Wideband: The New 3GPP2 Wideband Vocoder Standard"; Apr. 2007; IEEE International Conference on Acoustics, Speech, and Signal Processing, Honolulu, HI, USA, pp. II-333, XP03463184, ISBN:978-1-4244-0727-9 p. 334, line 8—p. 335, line 23; figure 1.

Sluijter R J; Janssen A J E M: "A time warper for speech signals"; Jun. 1999; 1999 IEEE Workshop on Speech Coding Proceedings, pp. 150-152, XP010345551; p. 150, left-hand column, line 10-line 40, p. 151, left-hand column, line 25—p. 152, right-hand column, line 3; figures 1-3.

Yang Gao et al: "eX-CELP: a speech coding paradigm"; May 2001; IEEE International Conference on Acoustics, Speech, and Signal Processing (ICASSP). Salt Lake City, UT, USA; vol. 2, pp. 689-692, XP010803749 ISBN:978-0-7803-7041-8 p. 690, line 12—line 28; figures 2,3.

Int'l Search Report mailed Nov. 12, 2009 in related PCT application No. PCT/EP2009/004757, 10 pages.

Int'l Search Report mailed Nov. 23, 2009 in related PCT application No. PCT/EP2009/004756, 13 pages.

Int'l Search Report mailed Nov. 2, 2009 in related PCT application No. PCT/EP2009/004758, 13 pages.

Int'l Search Report mailed Feb. 8, 2010 in related PCT application No. PCT/EP2009/004874, 29 pages.

Int'l Preliminary Report on Patentability completed Oct. 26, 2010 in related PCT application No. PCT/EP2009/004874, 25 pages.

* cited by examiner

| FIG 5A |
| --- |
| FIG 5B |

| FIG 5A |
| --- |
| FIG 5B |

910

$$\text{warp_node_values}[i] = \begin{cases} 1 & \text{for tw_data_present} = 0,\ 0 \le i \le \text{num_tw_nodes} \\ 1 & \text{for tw_data_present} = 1,\ i = 0 \\ \prod_{k=0}^{i-1} \text{warp_values_tbl}[\text{tw_ratio}[k]] & \text{for tw_data_present} = 1,\ 0 \le i \le \text{num_tw_nodes} \end{cases}$$

920

```
for ( i = 0 ; i < num_tw_nodes ; i++) {
    d = (warp_node_values[i+1] - warp_node_values [i] ) / interp_dist;
    for  ( j = 0 ; j < interp_dist; j++) {

            new_warp_contour [i*interp_dist + j] = warp_node_values[i-1] +
(j+1)*d;
        }
}
```

FIG 9A-1

930

$$\text{norm_fac} = \frac{1}{\text{past_warp_contour}[2 \cdot \text{n_long}-1]}$$

$$\text{past_warp_contour}[i] = \text{past_warp_contour}[i] \cdot \text{norm_fac for } 0 \leq i < 2 \cdot \text{n_long}$$ ← 932

$$\text{last_warp_sum} = \text{last_warp_sum} \cdot \text{norm_fac}$$ ← 934

$$\text{cur_warp_sum} = \text{cur_warp_sum} \cdot \text{norm_fac}$$ ← 936

$$\text{new_warp_sum} = \sum_{i=0}^{\text{n_long}-1} \text{new_warp_contour}[i]$$ ← 940

FIG 9A-2

```
past_warp_contour[n]= warp_contour[n+n_long], for 0≤n<2·n_long   ← 950
cur_warp_sum=new_warp_sum                                         ← 952
last_warp_sum=cur_warp_sum                                        ← 954

past_warp_contour[n]= 1, for 0≤n<2·n_long                         ← 960
cur_warp_sum=n_long                                               ← 962
last_warp_sum=n_long                                              ← 964
```

FIG 9B

990 warp_value_tbl

| Index (e.g. tw_ratio) | value (e.g. warp_value_tbl [tw_ratio]) |
|---|---|
| 0 | 0.982857168 |
| 1 | 0.988571405 |
| 2 | 0.994285703 |
| 3 | 1 |
| 4 | 1.0057143 |
| 5 | 1.01142859 |
| 6 | 1.01714289 |
| 7 | 1.02285719 |

FIG 9C time contour calculation $$\text{time_contour}[i] = \begin{cases} -w_{res} \cdot \text{last_warp_sum} & \text{for } i = 0 \\ w_{res}\left(-\text{last_warp_sum} + \sum_{k=0}^{i-1} \text{warp_contour}[k]\right) & \text{for } 0 < i \leq 3 \cdot \text{n_long} \end{cases} \longleftarrow 1010$$

$$\text{where } w_{res} = \frac{\text{n_long}}{\text{cur_warp_sum}} \longleftarrow 1012$$

helper functions

```
warp_time_inv (time_contour[], t_warp) {
        i = 0;
        if (t_warp < contour [0] ) {
                return NOTIME;
        }
        while ( t_warp > time_contour [i+1] ) {
                i++;
        }
        return (i + (t_warp - time_contour [i] ) / (time_contour [i+1] -
time_contour[i]));
}
```

1020

```
warp_inv_vec (time_contour[], t_start, n_samples, sample_pos[]) {
        t_warp = t_star;
        j = 0;
        while (( i = floor (warp_time_inv (time_contour, t_warp-0.5))) == NOTIME) {
                t_warp += 1;
                j++;
        }
        while ( j < n_samples && (t_warp + 0.5) < time_contour [3*n_long] ) {
                while ( t_warp < time_contour [i+1]) {
                        i++;
                }
                sample_pos[j] =
                        i + (t_warp - time_contour[i]) / (time_contour[i+1] -
                                time_contour[i]);
                j++;
                t_warp += 1;
        }
}
```

1022

FIG 10A sample position calculation,
trasition length calculation,
first position and last position calculation

```
t_start = n_long - 3*N_f/4 - ip_len_2s + 0.5

warp_inv_vec (time_contour,
              t_start,
              N_f + 2*ip_len_2s,
              sample_pos [] ) ;
```

1030

```
if ( last_warp_sum > cur_warp_sum ) {
      warped_trans_len_left = n_long/2;
}
else {
      warped_trans_len_left = n_long/2*last_warp_sum/cur_warp_sum;
}
if ( new_warpSum > cur_warp_sum ) {
      warped_trans_len_right = n_long/2;
}
else {
      warped_trans_len_right = n_long/2*new_warp_sum/cur_warp_sum;
}
```

1032

```
switch ( window_sequence ) {
      case LONG_START_SEQUENCE:
            warped_trans_len_right   /= 8;
            break;
      case LONG_STOP_SEQUENCE:
      case STOP_1152_SEQUENCE:
            warped_trans_len_right   /= 8;
            break;
      case EIGHT_SHORT_SEQUENCE:
      case STOP_START_SEQUENCE:
      case STOP_START_1152_SEQUENCE:
            warped_trans_len_right   /= 8;
            warped_trans_len_left    /= 8;

            break;
}
```

1034

```
first_pos = ceil (N_f/4 - 0.5 - warped_trans_len_left);
last_pos = floor (3*N_f/4 - 0.5+warped_trans_len_right);
```

1036

FIG 10B window shape calculation $$N_{os} = 2 \cdot n_long \cdot os_factor_win \qquad \leftarrow 1040$$

$$W_{KBD}\left(n - \frac{N_{os}}{2}\right) = \sqrt{\frac{\sum_{p=0}^{N_{os}-n-1} [W(p,a)]}{\sum_{p=0}^{N_{os}/2} [W(p,a)]}} \quad \text{for } \frac{N_{os}}{2} \le n < N_{os} \qquad \leftarrow 1042$$

where:

$$W'(n,a) = \frac{I_0\left[\pi\alpha\sqrt{1.0 - \left(\frac{n - N_{os}/4}{N_{os}/4}\right)}\right]}{I_0[\pi\alpha]} \quad \text{for } 0 \le n \le \frac{N_{os}}{2}$$

$$I_0[x] = \sum_{k=0}^{\infty}\left[\frac{\left(\frac{x}{2}\right)^k}{k!}\right]^2$$

$\alpha$ = kernel window alpha factor, $\alpha = 4$ ← 1044

$$W_{SIN}\left(n - \frac{N_{os}}{2}\right) = \sin\left(\frac{\pi}{N_{os}}\left(n + \frac{1}{2}\right)\right) \quad \text{for } \frac{N_{os}}{2} \le n < N_{os} \qquad \leftarrow 1046$$

$$\text{left_window_shape}[n] = \begin{cases} W_{KBD}[n], \text{ if window_shape_previous_block} = 1 \\ W_{SIN}[n], \text{ if window_shape_previous_block} = 0 \end{cases} \qquad \leftarrow 1048$$

$$\text{right_window_shape}[n] = \begin{cases} W_{KBD}[n], \text{ if window_shape} = 1 \\ W_{SIN}[n], \text{ if window_shape} = 0 \end{cases} \qquad \leftarrow 1050$$

FIG 10C

```
windowing ("EIGHT SHOT SEQUENCE")

tw_windowing_short (X [] [], z [], first_pos, last_pos, warpe_trans_len_left, warped_
trans_len_right, left_window_shape [], right_window_shape[]) {

  offset = n_long - 4*n_short - n_short/2;

  tr_scale_l = 0.5*n_long/warped_trans_len_left*os_factor_win;
  tr_pos_l = warped_trans_len_left+(first_pos-n_long/2) + 0.5)*tr_scale_l;
  tr_scale_r = 8*os_factor_win;
  tr_pos_r = tr_scale_r/2;

  for ( i = 0 ; i < n_shot ; i++ ) {
    z [i] = X [0] [i];
  }

  for (i=0; i<first_pos; i++)
    z [i] = 0. ;

  for ( i = n_long-1-first_pos; i>=first_pos; i-- ) {
    z [i] *= left_window_shape[floor(tr_pos_l)];
    tr_pos_l += tr_scale_l;
  }

  for ( i = 0; i<n_short; i++) {
    z [offset+i+n_short] =
          X[0] [i+n_short]*right_window_shape [floor (tr_pos_r)];
    tr_pos_r += tr_scale_r;
  }

  offset += n_short;

  for ( k = 1; k < 7 ; k++ ) {
    tr_scale_l = n_short*os_factor_win;
    tr_pos_l = tr_scale_1/2;
    tr_pos_r = os_factor_win*n_long-tr_pos_l;
1060 ---> for ( i = 0 ; i < n_short ; i++ ) {
      z [i + offset] += X [k] [i]*right_window_shape[floor(tr_pos_r)];
      z [offset + n_short + i] =
            X[k] [n_short + i]*right_window_shape [floor (tr_pos_l)];
      tr_pos_l += tr_scale_l;
      tr_pos_r - = tr_scale_l;
    }
    offset += n_short;
  }
```

FIG 10D-1

```
tr_scale_l = n_short*os_factor_win;
tr_pos_l = tr_scale_l/2;

for ( i = n_short - 1; i >= 0; i--) {
  z [i + offset] += X [7] [i]*right_window_shape [ (int) floor (tr_pos_l)];
  tr_pos_l += tr_scale_l;
}

  for ( i = 0 ; i < n_short; i++) {
  z [offset + n_short + i]= X [7] [n_short +i];
}

tr_scale_r = 0.5*n_long/warpedTransLenRight*os_factor_win;
tr_pos_r = 0.5*tr_scale_r+.5;

tr_pos_r = (1.5*n_long-(float) wEnd - 0.5 + warpedTransLenRight)*tr_scale_r;

for ( i = 3*n_long-1-last_pos ; i<=wEnd; i++) {
  z [i] *= right_window_shape[floor(tr_pos_r)];
  tr_pos_r += tr_scale_r;
}

for (i=lsat_pos+1; i<2*n_long; i++)
  z [i] = 0. ;
```

FIG 10D-2

```
windowing (ALL OTHERS)

tw_windowing_long (X [] [], z [], first_pos, last_pos, warpe_trans_len_left, warped_
trans_len_right, left_window_shape [], right_window_shape[]) {

  for ( i = 0 ; i < first_pos; i++)
    z [i]= 0.;
  for ( i =last_pos+1 ; i < N_f; i++)
    z [i]= 0.;

  tr_scale = 0.5*n_long/warped_trans_len_left*os_factor_win;
  tr_pos = (warped_trans_len_left+first_pos-N_f/4)+0.5)*tr_scale;

  for ( i = N_f/2-1-first_pos ; i>=first_pos; i--) {
1064 ---->  z [i] = X[0] [i]*left_window_shape [floor (tr_pos)]);
    tr_pos += tr_scale;
  }

  tr_scale = 0.5*n_long/warped_trans_len_right*os_factor_win;
  tr_pos = (3*N_f/4 - last_pos-0.5+warped_trans_len_right)*tr_scale;

  for ( i = 3*N_f/2-1- last_pos; i<=last_pos; i++) {
    z [i] = X[0] [i]*right_window_shape [floor (tr_pos)]);
    tr_pos += tr_scale;
  }
}
```

FIG 10E time varying resampling $$b[n] = I_0[\alpha]^{-1} \cdot I_0\left[\alpha\sqrt{1-\frac{n^2}{ip_len_2^2}}\right] \cdot \frac{\sin\left(\frac{\pi n}{os_factor_resamp}\right)}{\frac{\pi n}{os_factor_resamp}} \cdot \text{for } 0 \le n < ip_size - 1 \quad \leftarrow 1070$$

$\alpha = 8$ $$zp[n] = \begin{cases} 0, & \text{for } 0 \le n < ip_len_2s \\ z[n-ip_len_2s], & \text{for } ip_len_2s \le n < N_f + ip_len_2s \\ 0, & \text{for } 2 \cdot N_f + ip_len_2s \le n < N_f + 2 \cdot ip_len_2s \end{cases} \quad \leftarrow 1072$$

```
offset_pos = 0.5;
num_samples_in = N_f+2*ip_len_2s;
num_samples_out = 3*n_long;
j_center = 0;
for (i = 0; i < numSamplesOut; i++) {
    while (j_center<num_samples_in && sample_pos [j_center] - offset_pos <= i)
        j_center++;
    j_center--;
    y[i] = 0;
    if (j_center<num_samples_in-1 && j_center>0)  {
        frac_time = floor ((i- (sample_pos [j_center] - offset_pos))
                            / (sample_pos [j_center+1]-sample_pos [j_center])
                            *os_factor);
        j = ip_len_2s*os_factor+frac_time;

        for(k=j_center-ip_len_2s; k<=j_center+ip_len_2s; k++) {
          if (k>=0 && k<num_samples_in)


            y[i] += b[abs(j)]*zp[k];
          j -= os_factor;
        }
    }
    if (j_center<0)
        j_center++;
}
```

← 1074

FIG 10F a) EIGHT_SHORT_SEQUENCE, LONG_START_SEQUENCE, STOP_START_SEQUENCE, STOP_START_1152_SEQUENCE followed by a LPD SEQUENCE $$W_{corr}(n) = \frac{W_{short}(n)}{W_{FD_LPD}(n)}, \quad \text{for } 0 \le n < \frac{n_short}{2}$$ ← 1080a $$W_{short}(n) = \begin{cases} W_{SIN_RIGHT,\, n_short}(n), & \text{if window_shape} = 0 \\ W_{KBD_RIGHT,\, n_short}(n), & \text{if window_shape} = 1 \end{cases}$$

$$W_{FD_LPD}(n) = \begin{cases} W_{SIN_RIGHT,\, n_short/2}(n), & \text{if window_shape} = 0 \\ W_{KBD_RIGHT,\, n_short/2}(n), & \text{if window_shape} = 1 \end{cases}$$ ← 1080b is applied:

$$y'_{i,n} = \begin{cases} y[n] & , \text{for } 0 \le n < \frac{5n_long}{2} - \frac{n_short}{2} \\ y[n] \cdot W_{corr}\left(n - \left(\frac{5n_long}{2} - \frac{n_short}{2}\right)\right) & , \frac{5n_long}{2} - \frac{n_short}{2} \text{ for } \le n < \frac{5n_long}{2} \\ 0 & , \text{for } \frac{5n_long}{2} \le n < 3n_long \end{cases}$$ ← 1082 b) all other cases: ← 1084
nothing has to be done
$y'_{i,n} = y[n]$ for $0 \le n < 3 \cdot n_long$ overlapping and adding $$out_{i,n} = \begin{cases} y'_{i,n} + y'_{i-1,\, n+n_long} + y'_{i-2,\, n+2 \cdot n_long} & \text{for } 0 \le n < n_long/2 \\ y'_{i,n} + y'_{i-1,\, n+n_long} & \text{for } n_long/2 \le n < n_long \end{cases}$$ ← 1086

FIG 10G

Data elements

| | |
|---|---|
| tw_data() | contains the side information necessary to decode and apply the time warped MDCT on an fd_channel_stream() for SCE and CPE elements. The fd_channel_streams of a channel_pair_element() may share one common tw_data(). |
| tw_data_present | 1 bit indicating that a non-flat warp contour is transmitted in this frame |
| tw_ratio[] | codebook index of the warp ratio for node i. |
| window_sequence | 2 bit indicating which window sequence (i.e. block size) is used |
| window shape | 1 bit indicating which window function is selected. |

Help elements

| | |
|---|---|
| warp_node_values[] | decoded warp contour node values |
| warp_value_tbl | see table "warp_value_tbl" |
| warp_value_tbl[] | quantiziatiion table for the warp node ratio values, please see Table of Fig. 9C |
| new_warp_contour[] | decoded and interpolated warp contour for this frame (n_long samples) |
| past_warp_contour[] | past warp contour (2*n_long samples), comprising last_warp_contour and cur_warp_contour |
| norm_fac | normalization factor for the past *warp*_contour |
| warp_contour[] | complete warp contour (3*n_long samples) |
| last_warp_sum | sum of the first part of the warp contour |
| cur_warp_sum | sum of the middle part of the warp contour |
| next_warp_sum | sum of the last part of the warp contour |
| time_contour[] | complete time contour (3*n_long+1_ samples) |
| sample_pos[] | positions of the warped samples on a linear time scale (2*n_long samples+2*ip_len_2s) |
| X[w][] | output of the IMDCT for window w |

FIG 11A

Help elements (continued)

| | |
|---|---|
| z[] | windowed and (optionally) internally overlapped time vector for one frame in the time warped domain |
| zp[] | z[] with zero padding |
| y[] | time vector for one frame in the linear time domain after resampling |
| $y'_{i,n}$ | time vector for frame i after postprocessing |
| out[] | output vector for one frame |
| b[] | impulse response of the resampling filter |
| N | synthesis window length, see below |
| N_f | frame length, either 2304 in case of STOP_1152_SEQUENCE, STOP_START_1152_SEQUENCE or 2048 for all other window sequences |

Constants

| | |
|---|---|
| num_tw_nodes | 16 |
| os_factor_win | 16 |
| os_factor_resamp | 128 |
| ip_len_2s | 64 |
| ip_len_2 | os_factor_resamp*ip_len_2s+1 |
| ip_size | ip_len_2+os_factor_resamp |
| n_long | 1024 (960) |
| n_short | 128 (120) |
| interp_dist | n_long/num_tw_nodes |
| NOTIME | -100000 |

FIG 11B-1

Window length 2304:

$$N = \begin{cases} 2304, & \text{if STOP_1152_SEQUENCE} \\ 2304, & \text{if STOP_START_1152_SEQUENCE} \end{cases}$$

Window length 2048:

$$N = \begin{cases} 2048, & \text{if ONLY_LONG_SEQUENCE} \\ 2048, & \text{if LONG_START_SEQUENCE} \\ 256, & \text{if EIGHT_SHORT_SEQUENCE} \\ 2048, & \text{If LONG_STOP_SEQUENCE} \\ 2048, & \text{If STOP_START_SEQUENCE} \end{cases}$$

1190

FIG 11B-2

```
usac_raw_data_block ()
{
        single_channel_element ();
        or
        channel_pair_element ();
        or
        single_channel_element ();
        and
        channel_pair_element ();
}
```

FIG 19A

```
single_channel_element ()
{
        fd_channel_stream (*,*,*);
}
```

FIG 19B

```
channel_pair_element
{
if (tw_mdct) {
        common_tw;
        if (common_tw) {
                tw_data();
        }
}
fd_channel_stream (*,*,*);
fd_channel_stream (*,*,*);
}
```

FIG 19C

```
fd_channel_stream (*,*,*);
{
  global gain;
  if (tw_mdct) {
    if (not common_tw) {
        tw_data ();
    }
  }
 scale_factor_data ();
  ac_spectral_data ();
}
```

FIG 19D

| Syntax | No. of bits | Mnemonic |
|---|---|---|
| tw_data() | | |
| { | | |
| **tw_data_present** | **1** | **ulmsfb** |
| if ( tw_data_present == 1 ) { | | |
| for ( i= 1 ; i < num_tw_nodes ; i++ ) { | | |
| **tw_ratio**[i]; | **3** | **ulmsbf** |
| } | | |
| } | | |
| } | | |

FIG 19E

Syntax of pitch_data()

| Syntax | No. of bits | Mnemon |
|---|---|---|
| pitch_data() | | |
| { | | |
| activePitchData | 1 | uimsfb |
| if ( activePitchData == 1 ) { | | |
| for ( i= 1 ; i < numPitches ; i++ ) { | 1 | uimsbf |
| pitchidx[i]; | numPitchBits | uimsbf |
| } | | |
| } | | |
| } | | |

FIG 19F

AUDIO SIGNAL DECODER, TIME WARP CONTOUR DATA PROVIDER, METHOD AND COMPUTER PROGRAM

CROSS-REFERENCE TO RELATED APPLICATION

This application is a U.S. National Phase entry of PCT/EP2009/004757 filed Jul. 1, 2009, and claims priority to U.S. Patent Application No. 61/079,873 filed Jul. 11, 2008, and U.S. Patent Application No. 61/103,820 filed Oct. 8, 2008, each of which is incorporated herein by references hereto.

BACKGROUND OF THE INVENTION

Embodiments according to the invention are related to an audio signal decoder. Further embodiments according to the invention are related to a time warp contour data provider. Further embodiments according to the invention are related to a method for decoding an audio signal, a method for providing time warp contour data and to a computer program.

Some embodiments according to the invention are related to methods for a time warped MDCT transform coder.

In the following, a brief introduction will be given into the field of time warped audio encoding, concepts of which can be applied in conjunction with some of the embodiments of the invention.

In the recent years, techniques have been developed to transform an audio signal into a frequency domain representation, and to efficiently encode this frequency domain representation, for example taking into account perceptual masking thresholds. This concept of audio signal encoding is particularly efficient if the block length, for which a set of encoded spectral coefficients are transmitted, are long, and if only a comparatively small number of spectral coefficients are well above the global masking threshold while a large number of spectral coefficients are nearby or below the global masking threshold and can thus be neglected (or coded with minimum code length).

For example, cosine-based or sine-based modulated lapped transforms are often used in applications for source coding due to their energy compaction properties. That is, for harmonic tones with constant fundamental frequencies (pitch), they concentrate the signal energy to a low number of spectral components (sub-bands), which leads to an efficient signal representation.

Generally, the (fundamental) pitch of a signal shall be understood to be the lowest dominant frequency distinguishable from the spectrum of the signal. In the common speech model, the pitch is the frequency of the excitation signal modulated by the human throat. If only one single fundamental frequency would be present, the spectrum would be extremely simple, comprising the fundamental frequency and the overtones only. Such a spectrum could be encoded highly efficiently. For signals with varying pitch, however, the energy corresponding to each harmonic component is spread over several transform coefficients, thus leading to a reduction of coding efficiency.

In order to overcome this reduction of coding efficiency, the audio signal to be encoded is effectively resampled on a non-uniform temporal grid. In the subsequent processing, the sample positions obtained by the non-uniform resampling are processed as if they would represent values on a uniform temporal grid. This operation is commonly denoted by the phrase 'time warping'. The sample times may be advantageously chosen in dependence on the temporal variation of the pitch, such that a pitch variation in the time warped version of the audio signal is smaller than a pitch variation in the original version of the audio signal (before time warping). After time warping of the audio signal, the time warped version of the audio signal is converted into the frequency domain. The pitch-dependent time warping has the effect that the frequency domain representation of the time warped audio signal typically exhibits an energy compaction into a much smaller number of spectral components than a frequency domain representation of the original (non time warped) audio signal.

At the decoder side, the frequency-domain representation of the time warped audio signal is converted back to the time domain, such that a time-domain representation of the time warped audio signal is available at the decoder side. However, in the time-domain representation of the decoder-sided reconstructed time warped audio signal, the original pitch variations of the encoder-sided input audio signal are not included. Accordingly, yet another time warping by resampling of the decoder-sided reconstructed time domain representation of the time warped audio signal is applied. In order to obtain a good reconstruction of the encoder-sided input audio signal at the decoder, it is desirable that the decoder-sided time warping is at least approximately the inverse operation with respect to the encoder-sided time warping. In order to obtain an appropriate time warping, it is desirable to have an information available at the decoder which allows for an adjustment of the decoder-sided time warping.

As it is typically necessitated to transfer such an information from the audio signal encoder to the audio signal decoder, it is desirable to keep a bit rate needed for this transmission small while still allowing for a reliable reconstruction of the necessitated time warp information at the decoder side.

In view of the above discussion, there is a desire to have a concept which allows for a reliable reconstruction of a time warp information on the basis of an efficiently encoded representation of the time warp information.

SUMMARY

According to one embodiment, an audio signal decoder configured to provide a decoded audio signal representation on the basis of an encoded audio signal representation having a time warp contour evolution information may have a time warp calculator configured to generated time warp contour data repeatedly restarting from a predetermined time warp contour start value on the basis of the time warp contour evolution information describing a temporal evolution of the time warp contour; a time warp contour rescaler configured to rescale at least a portion of the time warp contour data such that a discontinuity at a restart is avoided, reduced or eliminated in a rescaled version of the time warp contour; and a warp decoder configured to provide the decoded audio signal representation on the basis of the encoded audio signal representation and using the rescaled version of the time warp contour.

According to another embodiment, a method for providing a decoded audio signal representation on the basis of an encoded audio signal representation having a time warp contour evolution information may have the steps of generating time warp contour data repeatedly restarting from a predetermined time warp contour start value on the basis of a time warp contour evolution information describing a temporal evolution of the time warp contour; rescaling at least a portion of the time warp contour data, such that a discontinuity at a restart is avoided, reduced or eliminated in a resealed version of the time warp contour; and providing the decoded audio signal representation on the basis of the encoded audio signal representation and using the resealed version of the time warp contour.

According to another embodiment, a time warp contour data provider for providing time warp contour data representing a temporal evolution of a relative pitch of an audio signal on the basis of a time warp contour evolution information may have a time warp contour calculator configured to generate time warp contour data on the basis of a time warp contour evolution information describing a temporal evolution of the time warp contour, wherein the time warp contour calculator is configured to repeatedly or periodically restart, at a restart position, a calculation of the time warp contour data from a predetermined time warp contour start value, thereby creating discontinuities of the time warp contour and reducing a range of the time warp contour data values; and a time warp contour rescaler configured to repeatedly rescale portions of the time warp contour, to reduce or eliminate the discontinuities at the restart positions in rescaled sections of the time warp contour.

An embodiment according to the invention creates an audio signal decoder configured to provide a decoded audio signal representation on the basis of an encoded audio signal representation comprising a time warp contour evolution information. The audio signal decoder comprises a time warp contour calculator configured to generate time warp contour data repeatedly restarting from a predetermined time warp contour start value on the basis of the time warp contour evolution information describing a temporal evolution of the time warp contour. The audio signal decoder also comprises a time warp contour rescaler configured to rescale at least a portion of the time warp contour data such that a discontinuity at a restart is avoided, reduced or eliminated in a rescaled version of the time warp contour. The audio signal decoder also comprises a time warp decoder configured to provide the decoded audio signal representation on the basis of the encoded audio signal representation and using the rescaled version of the time warp contour.

The above described embodiment is based on the finding that the time warp contour can be encoded with high efficiency using a representation which describes the temporal evolution, or relative change, of the time warp contour, because the temporal variation of the time warp contour (also designated as "evolution") is actually the characteristic quantity of the time warp contour, while the absolute value thereof is of no importance for a time warped audio signal encoding/decoding. However, it has been found that a reconstruction of a time warp contour on the basis of a time warp contour evolution information, describing a variation of the time warp contour over time, brings along the problem that an allowable range of values in a decoder may be exceeded, for example in the form of a numeric underflow or overflow. This is due to the fact that decoders typically comprise a number representation having a limited resolution. Further, it has been found that the risk of an underflow or overflow in the decoder can be eliminated by repeatedly restarting the reconstruction of the time warp contour from a predetermined time warp contour start value. Nevertheless, a mere restart of the reconstruction of the time warp contour brings along the problem that there are discontinuities in the time warp contour at the times of restart. Thus, it has been found that a rescaling can be used to avoid, eliminate, or at least reduce this discontinuity at the restart, where the reconstruction of the time contour is repeatedly restarted from the predetermined time warp contour start value.

To summarize the above, it has been found that a block-wise continuous time warp contour can be reconstructed without running the risk of a numeric overflow or underflow if the reconstruction of the time warp contour is repeatedly restarted from a predetermined time warp contour start value, and if the discontinuity arising from the restart is reduced or eliminated by a rescale of at least a portion of the time warp contour.

Accordingly, it can be achieved that the time warp contour is within a well-defined range of values surrounding the time warp contour start value within a certain temporal environment of the restart time. This is, in many cases, sufficient because typically only a temporal portion of the time warp contour, defined relative to a current time of audio signal reconstruction, is needed for a block-wise audio signal reconstruction, while "older" portions of the time warp contour are not needed for the present audio signal reconstruction.

To summarize the above, the embodiment described here allows for an efficient usage of a relative time warp contour information, describing a temporal evolution of the time warp contour, wherein a numeric overflow or underflow in the decoder can be avoided by the repeated restart of the time warp contour, and wherein a continuity of the time warp contour, which is often needed for the audio signal reconstruction, can be achieved even at the time of restart by an appropriate rescaling.

In the following, some embodiments will be discussed, which comprise optional improvements of the inventive concept.

In an embodiment of the invention, the time warp contour calculator is configured to calculate, starting from a predetermined starting value and using a first relative change information, a temporal evolution of a first portion of the time warp contour, and to calculate, starting from the predetermined starting value and using second relative change information, a temporal evolution of a second portion of the time warp contour, wherein the first portion of the time warp contour and the second portion of the time warp contour are subsequent portions of the time warp contour. The time warp contour rescaler is configured to rescale one of the portions of the time warp contour, to obtain a steady transition between the first portion of the time warp contour and the second portion of the time warp contour.

Using this concept, both the first time warp contour portion and the second time warp contour portion can be generated starting from a well-defined predetermined starting value, which may be identical for the reconstruction of the first time warp contour portion and the reconstruction of the second time warp contour portion. Assuming that the relative change information describes relative changes of the time warp contour in a limited range, it is ensured that the first portion of the time warp contour and the second portion of the time warp contour exhibit a limited range of values. Accordingly, a numeric underflow or a numeric overflow can be avoided.

Further, by rescaling of one of the portions of the time warp contour, a discontinuity at the transition from the first portion of the time warp contour to the second portion of the time warp contour (i.e. at the restart) can be reduced or even eliminated.

In an embodiment, the time warp contour rescaler is configured to rescale the first portion of the time warp contour such that a last value of the scaled version of the first portion of the time warp contour takes the predetermined starting value, or deviates from the predetermined starting value by no more than a predetermined tolerance value.

In this way, it can be achieved that a value of the time warp contour, which is at the transition from the first portion to the second portion, takes a predetermined value. Accordingly, a range of values can be kept particularly small, because a central value is fixed (or scaled to a predetermined value). For example, if both the first portion of the time warp contour and the second portion of the time warp contour are ascending, a minimum value of the resealed version of the first portion lies below the predetermined starting value, and an end value of the second portion lies above the predetermined starting value. However, a maximum deviation from the predetermined starting value is determined by a maximum of the ascent of the first portion and the ascent of the second portion. In contrast, if the first portion and the second portion were put together in a continuous way, without starting from the starting value and without rescaling, an end of the second portion would deviate from the starting value by the sum of the ascent of the first portion and the second portion.

Thus, it can be seen that a range of values (maximum deviation from the starting value) can be reduced by scaling a central value, at the transition between the first portion and the second portion, to take the starting value. This reduction of the range of values is particularly advantageous, because it supports the usage of a comparatively low resolution data format having a limited numeric range, which in turn allows for the design of cheap and power-efficient consumer devices, which is a continuous challenge in the field of audio coding.

In an embodiment, the rescaler is configured to multiply warp contour data values with a normalization factor to scale a portion of the time warp contour, or to divide warp contour data values by a normalization factor to scale the portion of the time warp contour. It has been found that a linear scaling (rather than, for example, an additive shift of the time warp contour) is particularly appropriate, because a multiplication scaling or division scaling maintains relative variations of the time warp contour, which are relevant for the time warping, other than absolute values of the time warp contour, which are of no importance.

In another embodiment, the time warp contour calculator is configured to obtain a warp contour sum value of a given portion of the time warp contour, and to scale the given portion of the time warp contour and the warp contour sum value of the given portion of the time warp contour using a common scaling value.

It has been found that in some cases, it is desirable to derive a warp contour sum value from the warp contour, because such a warp contour sum value can be used for a derivation of a time contour from the time warp contour. Thus, it is possible to use the given time warp contour and the corresponding warp contour sum value for the calculation of a first time contour. Further, it has been found that the scaled version of the time warp contour and the corresponding scaled sum value may be needed for a subsequent calculation of another time contour. So, it has been found that it is not needed to re-compute the warp contour sum value for the rescaled version of the given time warp contour from a new, because it is possible to derive the warp contour sum value of the rescaled version of the given portion of the warp contour by resealing the warp contour sum value of the original version of the given portion of the warp contour.

In an embodiment, the audio signal decoder comprises a time contour calculator configured to calculate a first time contour using time warp contour data values of a first portion of the time warp contour, of a second portion of the time warp contour and of a third portion of the time warp contour, and to calculate a second time contour using time warp contour data values of the second portion of the time warp contour, of the third portion of the time warp contour and of a fourth portion of the time warp contour. In other words, a first plurality of portions of the time warp contour (comprising three portions) is used for a calculation of the first time contour, and a second plurality of portions (comprising three portions) is used for a calculation of the second time contour, wherein the first plurality of portions is overlapping with the second plurality of portions. The time warp contour calculator is configured to generate time warp contour data of the first portion starting from a predetermined time warp contour start value on the basis of a time warp contour evolution information describing a temporal evolution of the first portion. Further, the time warp contour calculator is configured to rescale the first portion of the time warp contour, such that a last value of the first portion of the time warp contour comprises the predetermined time warp contour start value, to generate time warp contour data of the second portion of the time warp contour starting from the predetermined time warp contour start value on the basis of a time warp contour evolution information describing a temporal evolution of the second portion, and to jointly rescale the first portion and the second portion using a common scaling factor, such that a last value of the second portion comprises the predetermined time warp contour start value, so as to obtain jointly rescaled time warp contour data values. The time warp contour calculator is also configured to generate original time warp contour data values of the third portion of the time warp contour starting from the predetermined time warp contour start value on the basis of a time warp contour evolution information of the third portion of the time warp contour.

Accordingly, the first portion, the second portion and the third portion of the time warp contour are generated such that they form a continuous section of the time warp contour. Accordingly, the time contour calculator is configured to calculate the first time contour using the jointly resealed time warp contour data values of the first and second time warp contour portions and the time warp contour data values of the third time warp contour portion.

Subsequently, the time warp contour calculator is configured to jointly rescale the second, resealed portion and the third, original portion of the time warp contour using another common scaling factor, such that a last value of the third portion of the time warp contour comprises the predetermined time warp start value, so as to obtain a twice rescaled version of the second portion and a once rescaled version of the third portion of the time warp contour. Further, the time warp contour calculator is configured to generate original time warp contour data values of the fourth portion of the time warp contour starting from the predetermined time warp contour start value on the basis of a time warp contour evolution information of the fourth portion of the time warp contour. Further, the time warp contour calculator is configured to calculate the second time contour using the twice rescaled version of the second portion, the once rescaled version of the third portion and the original version of the fourth portion of the time warp contour.

Thus, it can be seen that the second portion and the third portion of the time warp contour are used both for the calculation of the first time contour and for the calculation of the second time contour. Nevertheless, there is a rescaling of the second portion and of the third portion between the calculation of the first time contour and the calculation of the second time contour, in order to keep the used range of values sufficiently small while ensuring the continuity of the time warp contour section considered for the calculation of the respective time contours.

In another embodiment, the signal decoder comprises a time warp control information calculator configured to calculate a time warp control information using a plurality of portions of the time warp contour. The time warp control information calculator is configured to calculate a time warp control information for the reconstruction of a first frame of the audio signal on the basis of time warp contour data of a first plurality of time warp contour portions, and to calculate a time warp control information for the reconstruction of a second frame of the audio signal, which is overlapping or non-overlapping with the first frame, on the basis of a time warp contour data of a second plurality of time warp contour portions. The first plurality of time warp contour portions is shifted, with respect to time, when compared to the second plurality of time warp contour portions. The first plurality of time warp contour portions comprises at least one common time warp contour portion with the second plurality of time warp contour portions. It has been found that the inventive rescaling approach brings along particular advantages if overlapping sections of the time warp contour (first plurality of time warp contour portions, and second plurality of time warp contour portions) are used for obtaining a time warp control information for the reconstruction of different audio frames (first audio frame and second audio frame). The continuity of the time warp contour, which is obtained by the rescaling, brings along particular advantages if overlapping sections of the time warp contour are used for obtaining the time warp control information, because the usage of overlapping sections of the time warp contour could result in severely degraded results, if there was any discontinuity of the time warp contour.

In another embodiment, the time warp contour calculator is configured to generate a new time warp contour such that the time warp contour restarts from the predetermined warp contour start value at a position within the first plurality of time warp contour portions, or within the second plurality of time warp contour portions, such that there is a discontinuity of the time warp contour at a location of the restart. To compensate for that, the time warp contour rescaler is configured to rescale the time warp contour such that the discontinuity is reduced or eliminated.

In another embodiment, the time warp contour calculator is configured to generate the time warp contour such that there is a first restart of the time warp contour from the predetermined time warp contour start value at a position within the first plurality of time warp contour portions, such that there is a first discontinuity at the position of the first restart. In this case, the time warp contour rescaler is configured to rescale the time warp contour such that the first discontinuity is reduced or eliminated. The time warp calculator is further configured to also generate the time warp contour such that there is a second restart of the time warp contour from the predetermined time warp contour start value, such that there is a second discontinuity at the position of the second restart. The rescaler is also configured to rescale the time warp contour such that the second discontinuity is reduced or eliminated.

In other words, it is sometimes advantageous to have a high number of time warp contour restarts, for example, one restart per audio frame. In this way, the processing algorithm can be made to be very regular. Also, the range of values can be kept very small.

In a further embodiment, the time warp calculator is configured to periodically restart the time warp contour starting from the predetermined time warp contour start value, such that there is a discontinuity at the restart. The rescaler is adapted to rescale at least a portion of the time warp contour to reduce or eliminate the discontinuity of the time warp contour at the restart. The audio signal decoder comprises a time warp control information calculator configured to combine rescaled time warp contour data from before a restart and time warp contour data from after the restart, to obtain time warp control information.

In a further embodiment, the time warp contour calculator is configured to receive an encoded warp ratio information to derive a sequence of warp ratio values from the encoded warp ratio information, and to obtain a plurality of warp contour node values, starting from the warp contour start value. Ratios between the warp contour start value associated with the warp contour start node and the warp contour node values are determined by the warp ratio values. It has been shown that the reconstruction of a time warp contour on the basis of a sequence of warp ratio values brings along very good results because the warp ratio values encode, in a very efficient way, the relative variation of the time warp contour, which is the key information for the application of a time warp. Thus, the warp ratio information has been found to be a very efficient description of the time warp contour evolution.

In another embodiment, the time warp contour calculator is configured to compute a warp contour node value of a given warp contour node, which is spaced from the time warp contour starting point by an intermediate warp contour node, on the basis of a product-formation comprising a ratio between the warp contour starting value and the warp contour node value of the intermediate warp contour node and a ratio between the warp contour node value of the intermediate warp contour node and the warp contour value of the given warp contour node as factors. It has been found that warp contour node values can be calculated in a particularly efficient way using a multiplication of a plurality of the warp ratio values. Also, usage of such a multiplication allows for a reconstruction of a warp contour, which is well adapted to the ideal characteristics of a warp contour.

A further embodiment according to the invention creates a time warp contour data provider for providing time warp contour data representing a temporal evolution of a relative pitch of an audio signal on the basis of a time warp contour evolution information. The time warp contour data provider comprises a time warp contour calculator configured to generate time warp contour data on the basis of a time warp contour evolution information describing a temporal evolution of the time warp contour. The time warp contour calculator is configured to repeatedly or periodically restart at restart positions, a calculation of the time warp contour data from a predetermined time warp contour start value, thereby creating discontinuities of the time warp contour and reducing a range of the time warp contour data values. The time warp contour data provider further comprises a time warp contour rescaler configured to repeatedly rescale portions of the time warp contour, to reduce or eliminate the discontinuity at the restart positions in resealed sections of the time warp contour. The time warp contour data provider is based on the same idea as the above described audio signal decoder.

A further embodiment according to the invention creates a method for providing a decoded audio signal representation on the basis of an encoded audio signal representation.

Yet another embodiment of the invention creates a computer program for providing a decoded audio signal on the basis of an encoded audio signal representation.

BRIEF DESCRIPTION OF THE DRAWINGS

Embodiments according to the invention will sequently be described taking reference to the enclosed figures, in which:

FIGS. 9*a* and 9*b* show algorithms for the calculation of the time warp contour;

FIG. 9*c* shows a table of a mapping from a time warp ratio index to a time warp ratio value;

FIGS. 10*a* and 10*b* show representations of algorithms for the calculation of a time contour, a sample position, a transition length, a "first position" and a "last position";

FIG. 10*c* shows a representation of algorithms for a window shape calculation;

FIGS. 10*d* and 10*e* show a representation of algorithms for an application of a window;

FIG. 10*f* shows a representation of algorithms for a time-varying resampling;

FIG. 10*g* shows a graphical representation of algorithms for a post time warping frame processing and for an overlapping and adding;

FIGS. 11*a* and 11*b* show a legend;

FIGS. 19*a*-19*f* show representations of syntax elements of an audio stream, according to an embodiment of the invention;

DETAILED DESCRIPTION OF THE INVENTION

1. Time Warp Audio Encoder According to FIG. 1

As the present invention is related to time warp audio encoding and time warp audio decoding, a short overview will be given of a prototype time warp audio encoder and a time warp audio decoder, in which the present invention can be applied.

Figure 1:
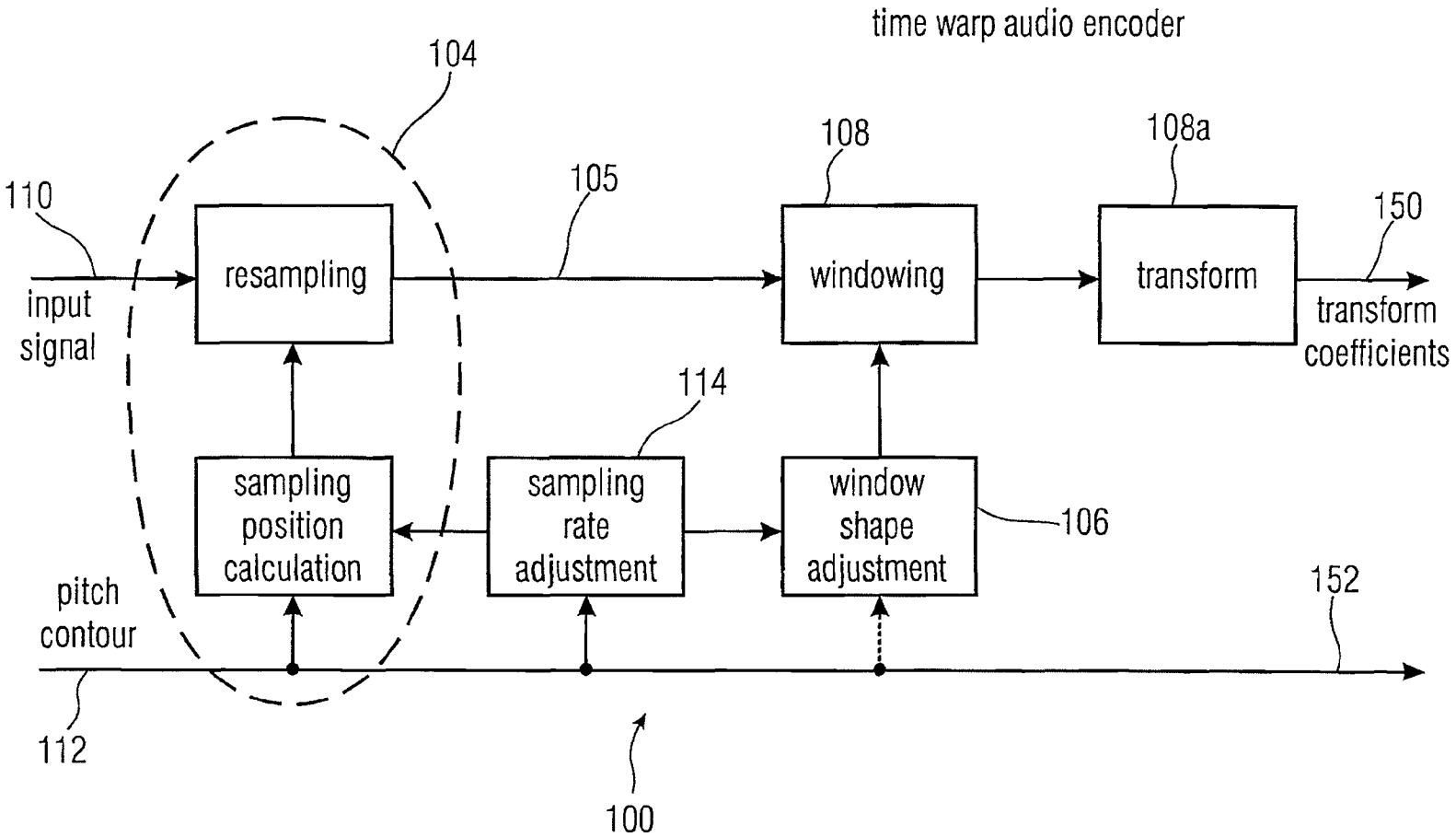
FIG. 1 shows a block schematic diagram of a time warp audio encoder.

FIG. 1 shows a block schematic diagram of a time warp audio encoder, into which some aspects and embodiments of the invention can be integrated. The audio signal encoder 100 of FIG. 1 is configured to receive an input audio signal 110 and to provide an encoded representation of the input audio signal 110 in a sequence of frames. The audio encoder 100 comprises a sampler 104, which is adapted to sample the audio signal 110 (input signal) to derive signal blocks (sampled representations) 105 used as a basis for a frequency domain transform. The audio encoder 100 further comprises a transform window calculator 106, adapted to derive scaling windows for the sampled representations 105 output from the sampler 104. These are input into a windower 108 which is adapted to apply the scaling windows to the sampled representations 105 derived by the sampler 104. In some embodiments, the audio encoder 100 may additionally comprise a frequency domain transformer 108*a*, in order to derive a frequency-domain representation (for example in the form of transform coefficients) of the sampled and scaled representations 105. The frequency domain representations may be processed or further transmitted as an encoded representation of the audio signal 110.

The audio encoder 100 further uses a pitch contour 112 of the audio signal 110, which may be provided to the audio encoder 100 or which may be derived by the audio encoder 100. The audio encoder 100 may therefore optionally comprise a pitch estimator for deriving the pitch contour 112. The sampler 104 may operate on a continuous representation of the input audio signal 110. Alternatively, the sampler 104 may operate on an already sampled representation of the input audio signal 110. In the latter case, the sampler 104 may resample the audio signal 110. The sampler 104 may for example be adapted to time warp neighboring overlapping audio blocks such that the overlapping portion has a constant pitch or reduced pitch variation within each of the input blocks after the sampling.

The transform window calculator 106 derives the scaling windows for the audio blocks depending on the time warping performed by the sampler 104. To this end, an optional sampling rate adjustment block 114 may be present in order to define a time warping rule used by the sampler, which is then also provided to the transform window calculator 106. In an alternative embodiment the sampling rate adjustment block 114 may be omitted and the pitch contour 112 may be directly provided to the transform window calculator 106, which may itself perform the appropriate calculations. Furthermore, the sampler 104 may communicate the applied sampling to the transform window calculator 106 in order to enable the calculation of appropriate scaling windows.

The time warping is performed such that a pitch contour of sampled audio blocks time warped and sampled by the sampler 104 is more constant than the pitch contour of the original audio signal 110 within the input block.

2. Time Warp Audio Decoder According to FIG. 2

Figure 2:
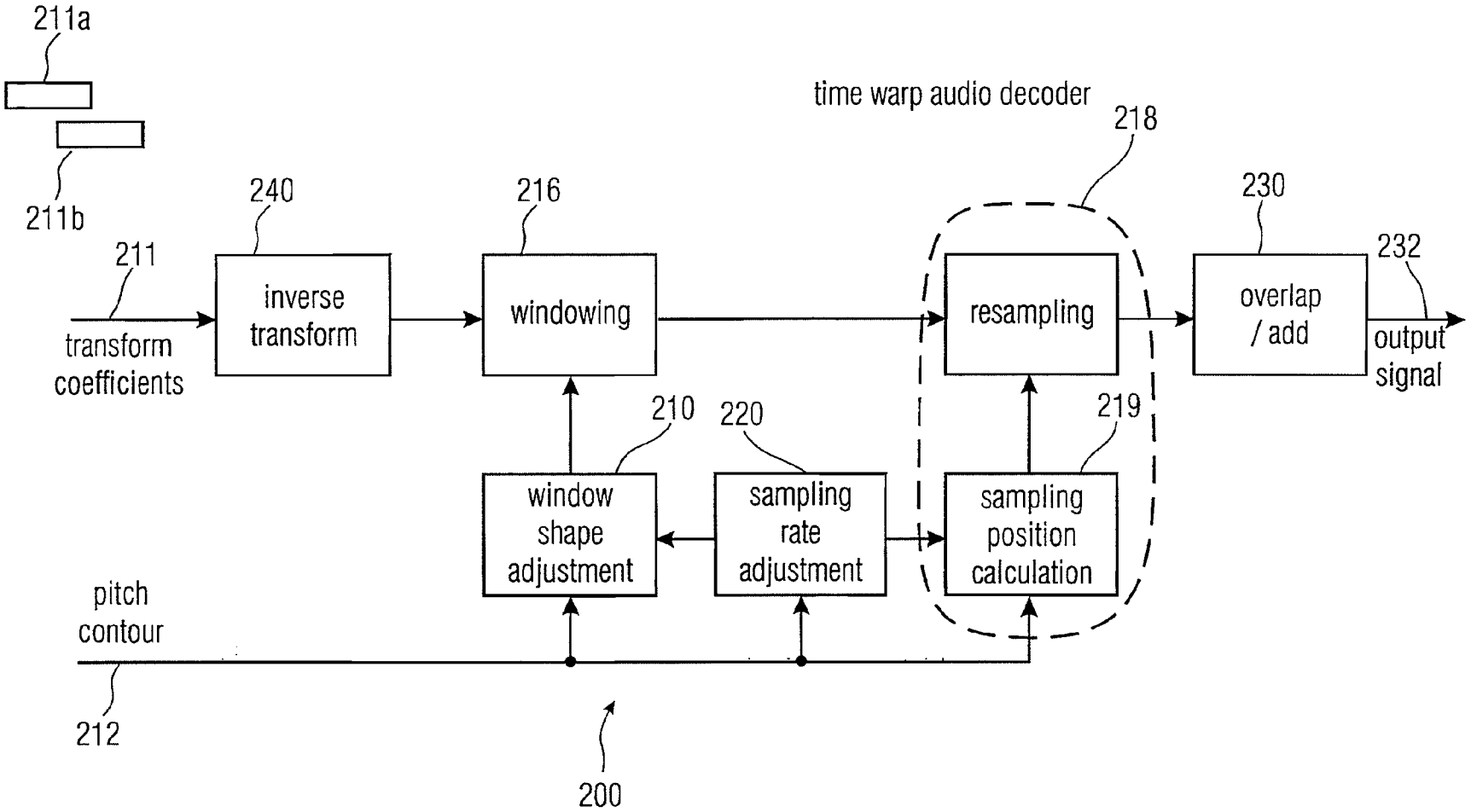
FIG. 2 shows a block schematic diagram of a time warp audio decoder.

FIG. 2 shows a block schematic diagram of a time warp audio decoder 200 for processing a first time warped and sampled, or simply time warped representation of a first and second frame of an audio signal having a sequence of frames in which the second frame follows the first frame and for further processing a second time warped representation of the second frame and of a third frame following the second frame in the sequence of frames. The audio decoder 200 comprises a transform window calculator 210 adapted to derive a first scaling window for the first time warped representation 211*a* using information on a pitch contour 212 of the first and the second frame and to derive a second scaling window for the second time warped representation 211*b* using information on a pitch contour of the second and the third frame, wherein the scaling windows may have identical numbers of samples and wherein the first number of samples used to fade out the first scaling window may differ from a second number of samples used to fade in the second scaling window. The audio decoder 200 further comprises a windower 216 adapted to apply the first scaling window to the first time warped representation and to apply the second scaling window to the second time warped representation. The audio decoder 200 furthermore comprises a resampler 218 adapted to inversely time warp the first scaled time warped representation to derive a first sampled representation using the information on the pitch contour of the first and the second frame and to inversely time warp the second scaled time warped representation to derive a second sampled representation using the information on the pitch contour of the second and the third frame such that a portion of the first sampled representation corresponding to the second frame comprises a pitch contour which equals, within a predetermined tolerance range, a pitch contour of the portion of the second sampled representation corresponding to the second frame. In order to derive the scaling window, the transform window calculator 210 may either receive the pitch contour 212 directly or receive information on the time warping from an optional sample rate adjustor 220, which receives the pitch contour 212 and which derives a inverse time warping strategy in such a manner that the pitch becomes the same in the overlapping regions, and optionally the different fading lengths of overlapping window parts before the inverse time warping become the same length after the inverse time warping.

The audio decoder 200 furthermore comprises an optional adder 230, which is adapted to add the portion of the first sampled representation corresponding to the second frame and the portion of the second sampled representation corresponding to the second frame to derive a reconstructed representation of the second frame of the audio signal as an output signal 242. The first time-warped representation and the second time-warped representation could, in one embodiment, be provided as an input to the audio decoder 200. In a further embodiment, the audio decoder 200 may, optionally, comprise an inverse frequency domain transformer 240, which may derive the first and the second time warped representations from frequency domain representations of the first and second time warped representations provided to the input of the inverse frequency domain transformer 240.

3. Time Warp Audio Signal Decoder According to FIG. 3

Figure 3:
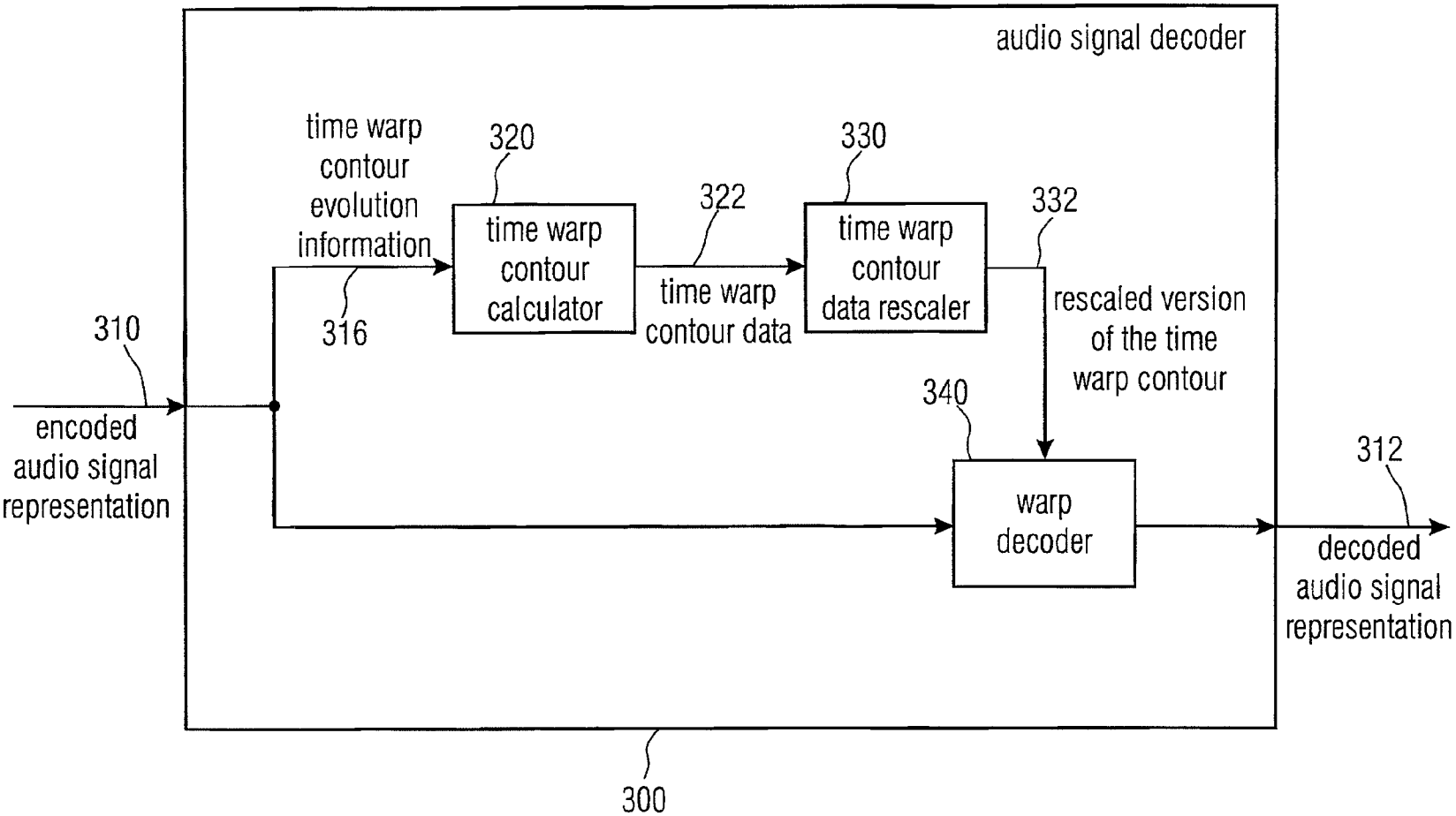
FIG. 3 shows a block schematic diagram of an audio signal decoder, according to an embodiment of the invention.

In the following, a simplified audio signal decoder will be described. FIG. 3 shows a block schematic diagram of this simplified audio signal decoder 300. The audio signal decoder 300 is configured to receive the encoded audio signal representation 310, and to provide, on the basis thereof, a decoded audio signal representation 312, wherein the encoded audio signal representation 310 comprises a time warp contour evolution information. The audio signal decoder 300 comprises a time warp contour calculator 320 configured to generate time warp contour data 322 on the basis of the time warp contour evolution information 316, which time warp contour evolution information describes a temporal evolution of the time warp contour, and which time warp contour evolution information is comprised by the encoded audio signal representation 310. When deriving the time warp contour data 322 from the time warp contour evolution information 316, the time warp contour calculator 320 repeatedly restarts from a predetermined time warp contour start value, as will be described in detail in the following. The restart may have the consequence that the time warp contour comprises discontinuities (step-wise changes which are larger than the steps encoded by the time warp contour evolution information 316). The audio signal decoder 300 further comprises a time warp contour data rescaler 330 which is configured to rescale at least a portion of the time warp contour data 322, such that a discontinuity at a restart of the time warp contour calculation is avoided, reduced or eliminated in a resealed version 332 of the time warp contour.

The audio signal decoder 300 also comprises a warp decoder 340 configured to provide a decoded audio signal representation 312 on the basis of the encoded audio signal representation 310 and using the resealed version 332 of the time warp contour.

To put the audio signal decoder 300 into the context of time warp audio decoding, it should be noted that the encoded audio signal representation 310 may comprise an encoded representation of the transform coefficients 211 and also an encoded representation of the pitch contour 212 (also designated as time warp contour). The time warp contour calculator 320 and the time warp contour data rescaler 330 may be configured to provide a reconstructed representation of the pitch contour 212 in the form of the resealed version 332 of the time warp contour. The warp decoder 340 may, for example, take over the functionality of the windowing 216, the resampling 218, the sample rate adjustment 220 and the window shape adjustment 210. Further, the warp decoder 340 may, for example, optionally, comprise the functionality of the inverse transform 240 and of the overlap/add 230, such that the decoded audio signal representation 312 may be equivalent to the output audio signal 232 of the time warp audio decoder 200.

By applying the rescaling to the time warp contour data 322, a continuous (or at least approximately continuous) resealed version 332 of the time warp contour can be obtained, thereby ensuring that a numeric overflow or underflow is avoided even when using an efficient-to-encode relative time warp contour evolution information.

4. Method for Providing a Decoded Audio Signal Representation According to FIG. 4

Figure 4:
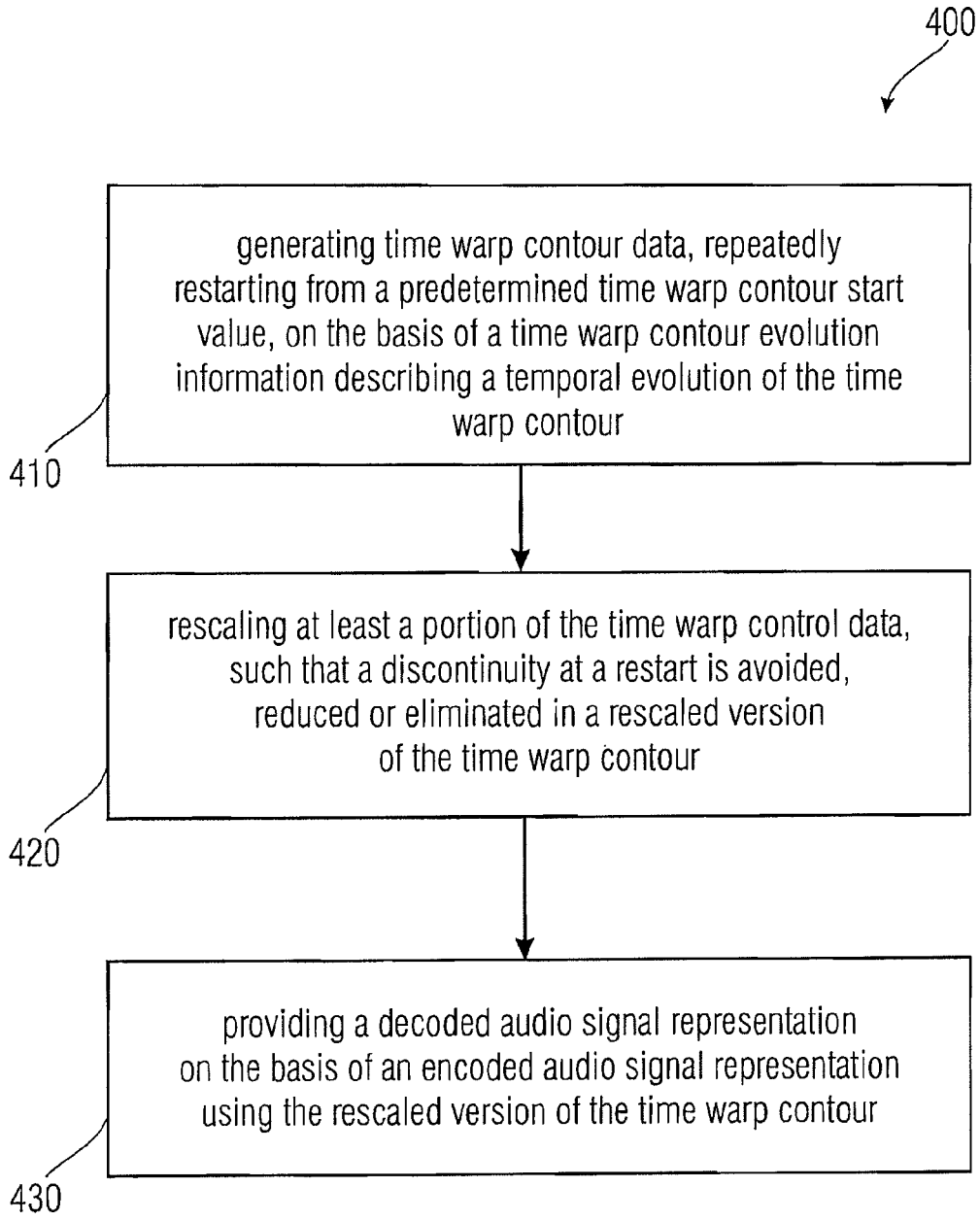
FIG. 4 shows a flowchart of a method for providing a decoded audio signal representation, according to an embodiment of the invention.

FIG. 4 shows a flowchart of a method for providing a decoded audio signal representation on the basis of an encoded audio signal representation comprising a time warp contour evolution information, which can be performed by the apparatus 300 according to FIG. 3. The method 400 comprises a first step 410 of generating the time warp contour data, repeatedly restarting from a predetermined time warp contour start value, on the basis of a time warp contour evolution information describing a temporal evolution of the time warp contour.

The method 400 further comprises a step 420 of rescaling at least a portion of the time warp control data, such that a discontinuity at one of the restarts is avoided, reduced or eliminated in a rescaled version of the time warp contour.

The method 400 further comprises a step 430 of providing a decoded audio signal representation on the basis of the encoded audio signal representation using the resealed version of the time warp contour.

5. Detailed Description of an Embodiment According to the Invention Taking Reference to FIGS. 5-9

In the following, an embodiment according to the invention will be described in detail taking reference to FIGS. 5-9.

Figure 5A:
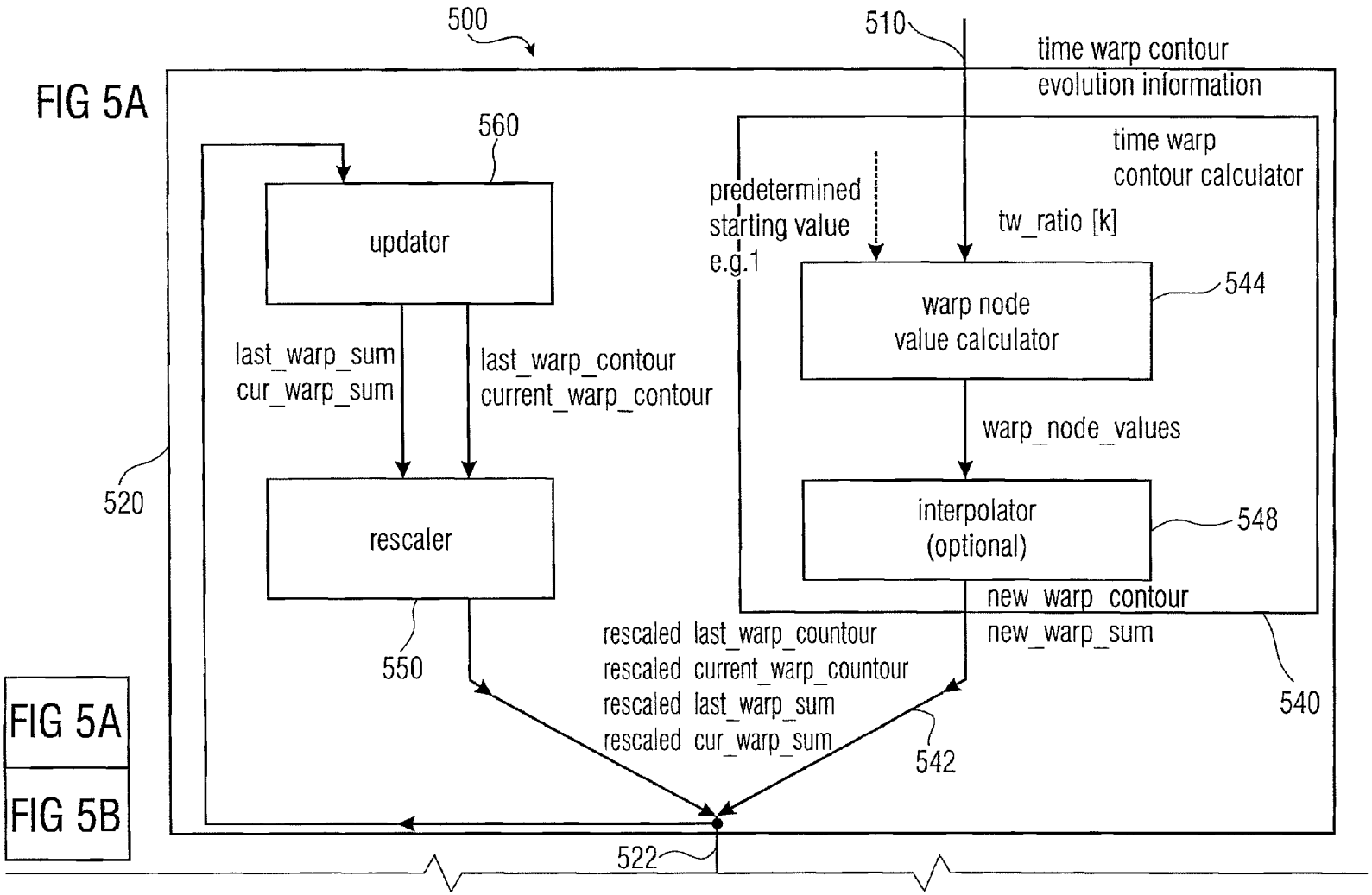
FIG. 5 shows a detailed extract from a block schematic diagram of an audio signal decoder according to an embodiment of the invention.
Figure 5B:
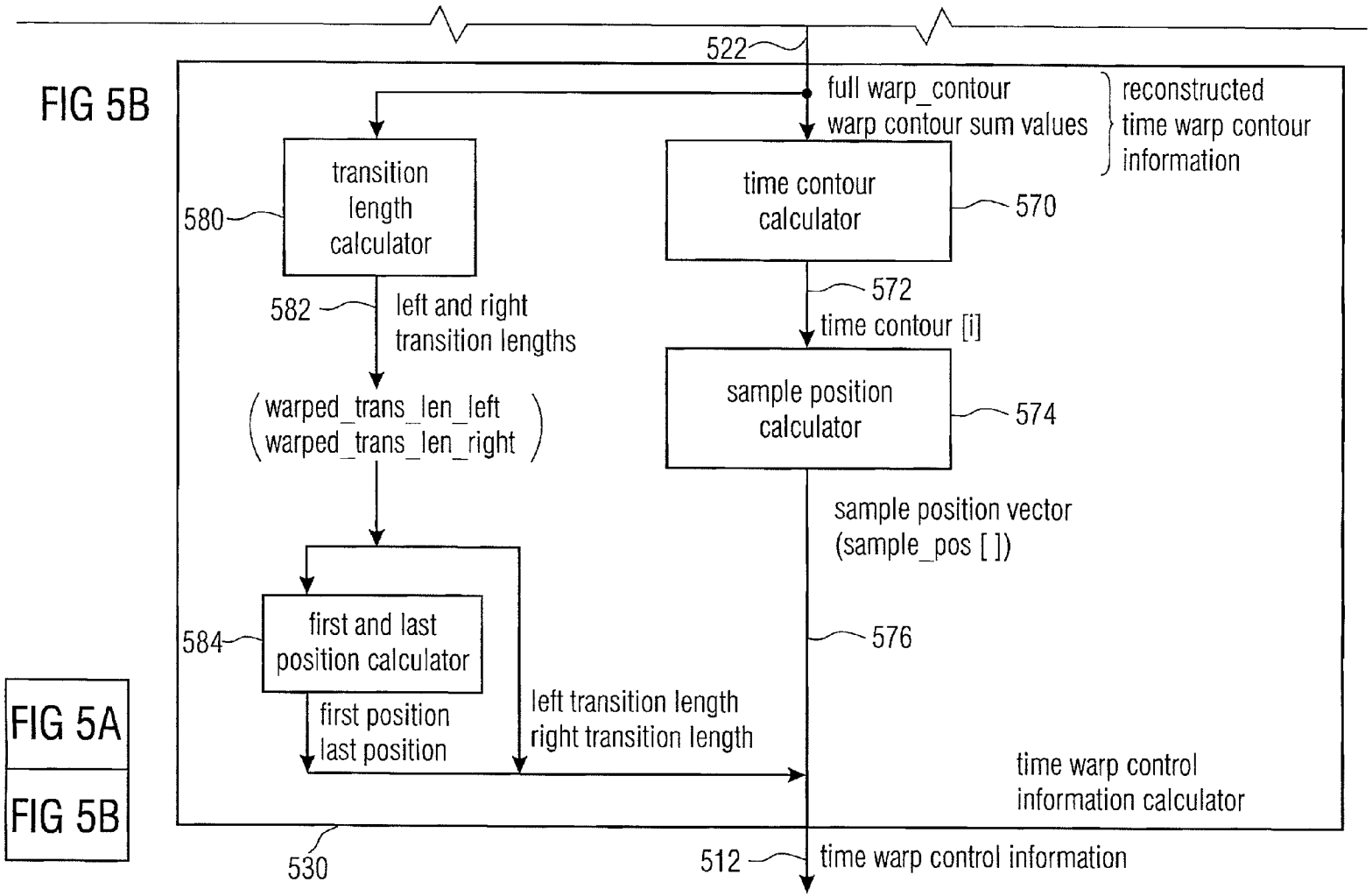

FIG. 5 shows a block schematic diagram of an apparatus 500 for providing a time warp control information 512 on the basis of a time warp contour evolution information 510. The apparatus 500 comprises a means 520 for providing a reconstructed time warp contour information 522 on the basis of the time warp contour evolution information 510, and a time warp control information calculator 530 to provide the time warp control information 512 on the basis of the reconstructed time warp contour information 522.

Means 520 for Providing the Reconstructed Time Warp Contour Information

In the following, the structure and functionality of the means 520 will be described. The means 520 comprises a time warp contour calculator 540, which is configured to receive the time warp contour evolution information 510 and to provide, on the basis thereof, a new warp contour portion information 542. For example, a set of time warp contour evolution information may be transmitted to the apparatus 500 for each frame of the audio signal to be reconstructed. Nevertheless, the set of time warp contour evolution information 510 associated with a frame of the audio signal to be reconstructed may be used for the reconstruction of a plurality of frames of the audio signal. Similarly, a plurality of sets of time warp contour evolution information may be used for the reconstruction of the audio content of a single frame of the audio signal, as will be discussed in detail in the following. As a conclusion, it can be stated that in some embodiments, the time warp contour evolution information 510 may be updated at the same rate at which sets of the transform domain coefficient of the audio signal to be reconstructed or updated (one time warp contour portion per frame of the audio signal).

The time warp contour calculator 540 comprises a warp node value calculator 544, which is configured to compute a plurality (or temporal sequence) of warp contour node values on the basis of a plurality (or temporal sequence) of time warp contour ratio values (or time warp ratio indices), wherein the time warp ratio values (or indices) are comprised by the time warp contour evolution information 510. For this purpose, the warp node value calculator 544 is configured to start the provision of the time warp contour node values at a predetermined starting value (for example 1) and to calculate subsequent time warp contour node values using the time warp contour ratio values, as will be discussed below.

Further, the time warp contour calculator 540 optionally comprises an interpolator 548 which is configured to interpolate between subsequent time warp contour node values. Accordingly, the description 542 of the new time warp contour portion is obtained, wherein the new time warp contour portion typically starts from the predetermined starting value used by the warp node value calculator 524. Furthermore, the means 520 is configured to consider additional time warp contour portions, namely a so-called "last time warp contour portion" and a so-called "current time warp contour portion" for the provision of a full time warp contour section. For this purpose, means 520 is configured to store the so-called "last time warp contour portion" and the so-called "current time warp contour portion" in a memory not shown in FIG. 5.

However, the means 520 also comprises a rescaler 550, which is configured to rescale the "last time warp contour portion" and the "current time warp contour portion" to avoid (or reduce, or eliminate) any discontinuities in the full time warp contour section, which is based on the "last time warp contour portion", the "current time warp contour portion" and the "new time warp contour portion". For this purpose, the rescaler 550 is configured to receive the stored description of the "last time warp contour portion" and of the "current time warp contour portion" and to jointly rescale the "last time warp contour portion" and the "current time warp contour portion", to obtain rescaled versions of the "last time warp contour portion" and the "current time warp contour portion". Details regarding the rescaling performed by the rescaler 550 will be discussed below, taking reference to FIGS. 7*a*, 7*b* and 8.

Moreover, the rescaler 550 may also be configured to receive, for example from a memory not shown in FIG. 5, a sum value associated with the "last time warp contour portion" and another sum value associated with the "current time warp contour portion". These sum values are sometimes designated with "last_warp_sum" and "cur_warp_sum", respectively. The rescaler 550 is configured to rescale the sum values associated with the time warp contour portions using the same rescale factor which the corresponding time warp contour portions are resealed with. Accordingly, resealed sum values are obtained.

In some cases, the means 520 may comprise an updater 560, which is configured to repeatedly update the time warp contour portions input into the rescaler 550 and also the sum values input into the rescaler 550. For example, the updater 560 may be configured to update said information at the frame rate. For example, the "new time warp contour portion" of the present frame cycle may serve as the "current time warp contour portion" in a next frame cycle. Similarly, the resealed "current time warp contour portion" of the current frame cycle may serve as the "last time warp contour portion" in a next frame cycle. Accordingly, a memory efficient implementation is created, because the "last time warp contour portion" of the current frame cycle may be discarded upon completion of the current frame cycle.

To summarize the above, the means 520 is configured to provide, for each frame cycle (with the exception of some special frame cycles, for example at the beginning of a frame sequence, or at the end of a frame sequence, or in a frame in which time warping is inactive) a description of a time warp contour section comprising a description of a "new time warp contour portion", of a "resealed current time warp contour portion" and of a "resealed last time warp contour portion". Furthermore, the means 520 may provide, for each frame cycle (with the exception of the above mentioned special frame cycle) a representation of warp contour sum values, for example, comprising a "new time warp contour portion sum value", a "resealed current time warp contour sum value" and a "resealed last time warp contour sum value".

The time warp control information calculator 530 is configured to calculate the time warp control information 512 on the basis of the reconstructed time warp contour information provided by the means 520. For example, the time warp control information calculator comprises a time contour calculator 570, which is configured to compute a time contour 572 on the basis of the reconstructed time warp control information. Further, the time warp contour information calculator 530 comprises a sample position calculator 574, which is configured to receive the time contour 572 and to provide, on the basis thereof, a sample position information, for example in the form of a sample position vector 576. The sample position vector 576 describes the time warping performed, for example, by the resampler 218.

The time warp control information calculator 530 also comprises a transition length calculator, which is configured to derive a transition length information from the reconstructed time warp control information. The transition length information 582 may, for example, comprise an information describing a left transition length and an information describing a right transition length. The transition length may, for example, depend on a length of time segments described by the "last time warp contour portion", the "current time warp contour portion" and the "new time warp contour portion". For example, the transition length may be shortened (when compared to a default transition length) if the temporal extension of a time segment described by the "last time warp contour portion" is shorter than a temporal extension of the time segment described by the "current time warp contour portion", or if the temporal extension of a time segment described by the "new time warp contour portion" is shorter than the temporal extension of the time segment described by the "current time warp contour portion".

In addition, the time warp control information calculator 530 may further comprise a first and last position calculator 584, which is configured to calculate a so-called "first position" and a so-called "last position" on the basis of the left and right transition length. The "first position" and the "last position" increase the efficiency of the resampler, as regions outside of these positions are identical to zero after windowing and are therefore not needed to be taken into account for the time warping. It should be noted here that the sample position vector 576 comprises, for example, information needed by the time warping performed by the resampler 280. Furthermore, the left and right transition length 582 and the "first position" and "last position" 586 constitute information, which is, for example, needed by the windower 216.

Accordingly, it can be said that the means 520 and the time warp control information calculator 530 may together take over the functionality of the sample rate adjustment 220, of the window shape adjustment 210 and of the sampling position calculation 219.

In the following, the functionality of an audio decoder comprises the means 520 and the time warp control information calculator 530 will be described with reference to FIGS. 6, 7*a*, 7*b*, 8, 9*a*-9*c*, 10*a*-10*g*, 11*a*, 11*b* and 12.

Figures 6A, 6B:
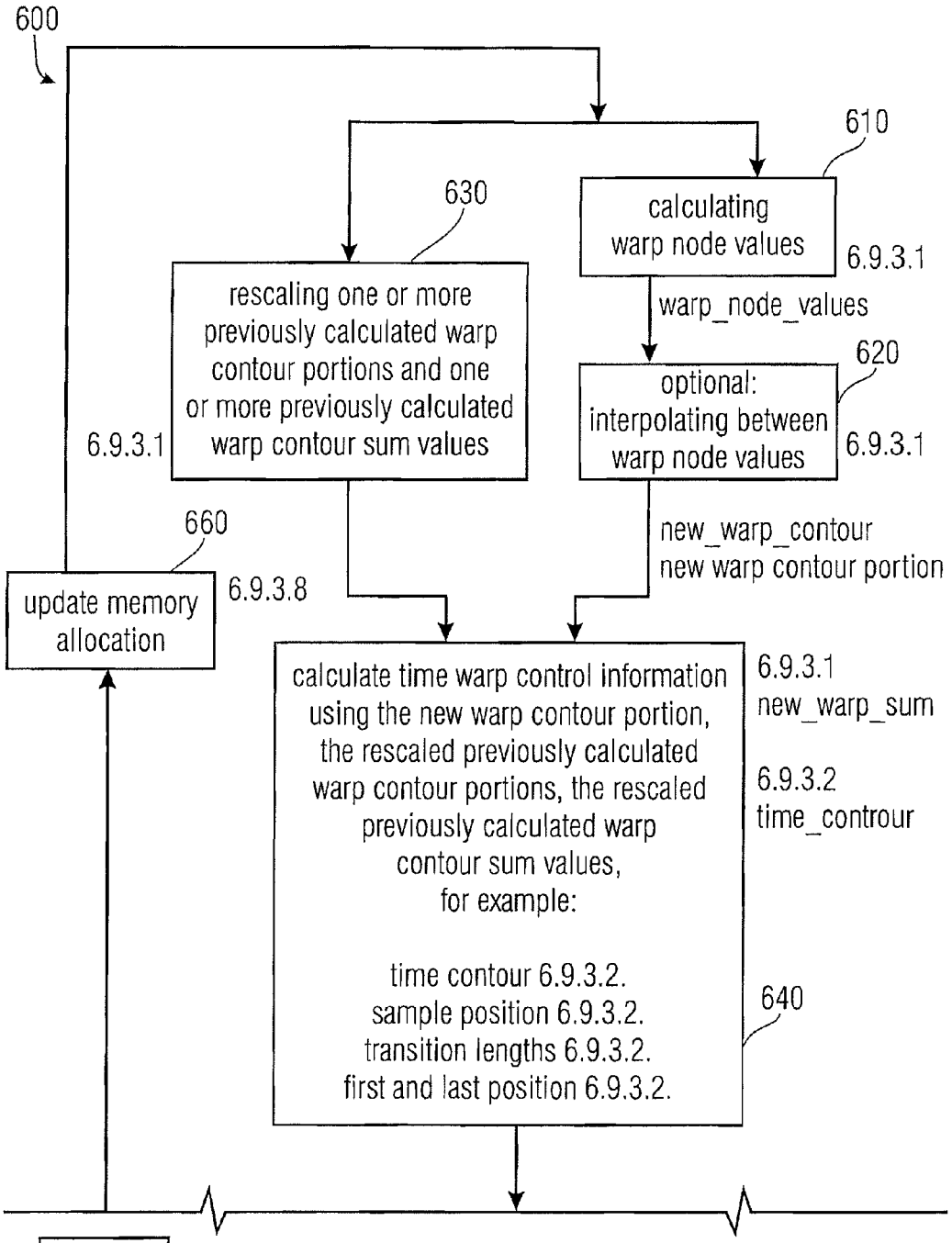
FIG. 6 shows a detailed extract of a flowchart of a method for providing a decoded audio signal representation according to an embodiment of the invention.
Figures 6A, 6B:
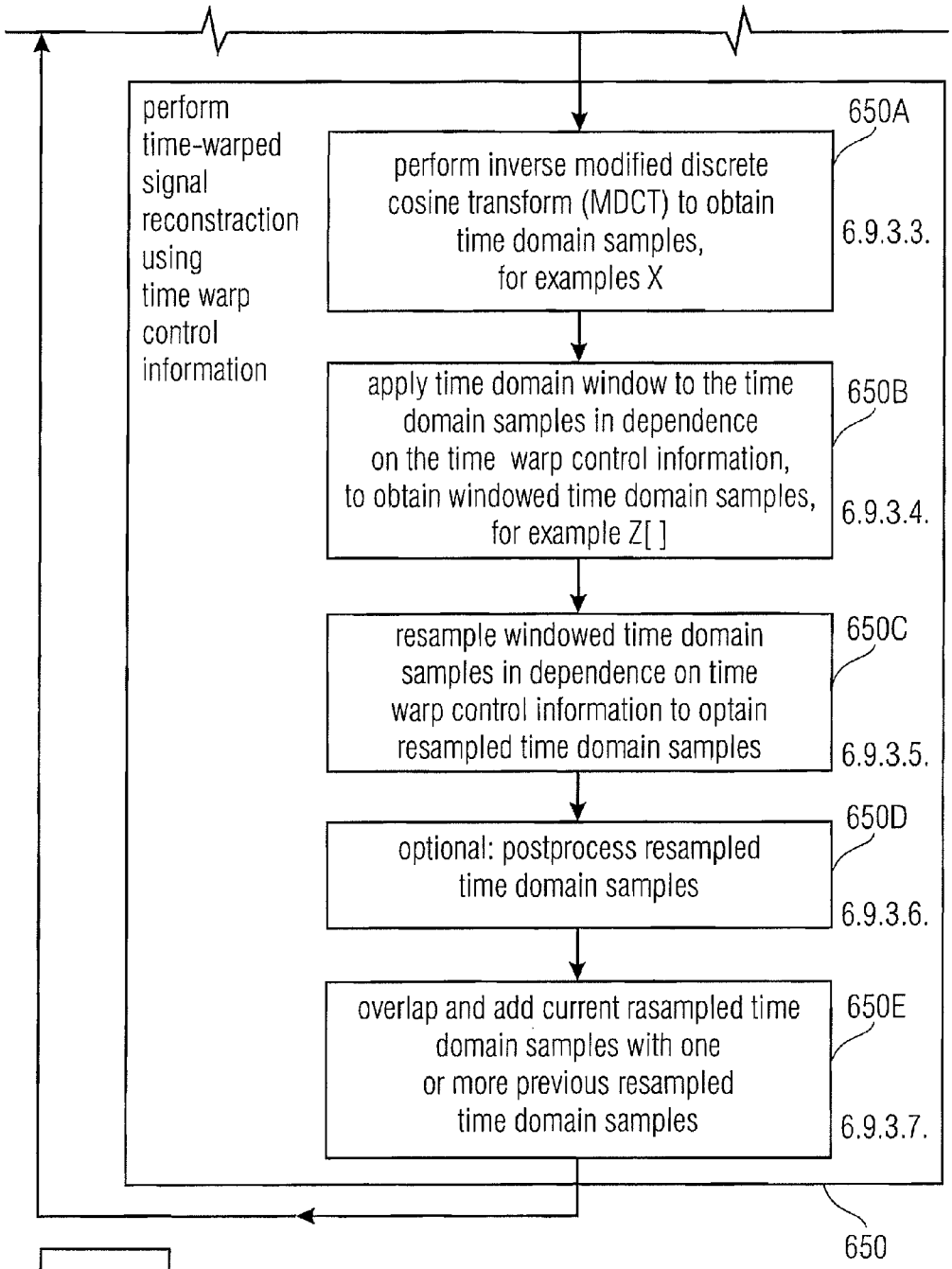

FIG. 6 shows a flowchart of a method for decoding an encoded representation of an audio signal, according to an embodiment of the invention. The method 600 comprises providing a reconstructed time warp contour information, wherein providing the reconstructed time warp contour information comprises calculating 610 warp node values, interpolating 620 between the warp node values and rescaling 630 one or more previously calculated warp contour portions and one or more previously calculated warp contour sum values. The method 600 further comprises calculating 640 time warp control information using a "new time warp contour portion" obtained in steps 610 and 620, the resealed previously calculated time warp contour portions ("current time warp contour portion" and "last time warp contour portion") and also, optionally, using the resealed previously calculated warp contour sum values. As a result, a time contour information, and/or a sample position information, and/or a transition length information and/or a first portion and last position information can be obtained in the step 640.

The method 600 further comprises performing 650 time warped signal reconstruction using the time warp control information obtained in step 640. Details regarding the time warp signal reconstruction will be described subsequently.

The method 600 also comprises a step 660 of updating a memory, as will be described below.

Calculation of the Time Warp Contour Portions

In the following, details regarding the calculation of the time warp contour portions will be described, taking reference to FIGS. 7*a*, 7*b*, 8, 9*a*, 9*b*, 9*c*.

Figure 7A:
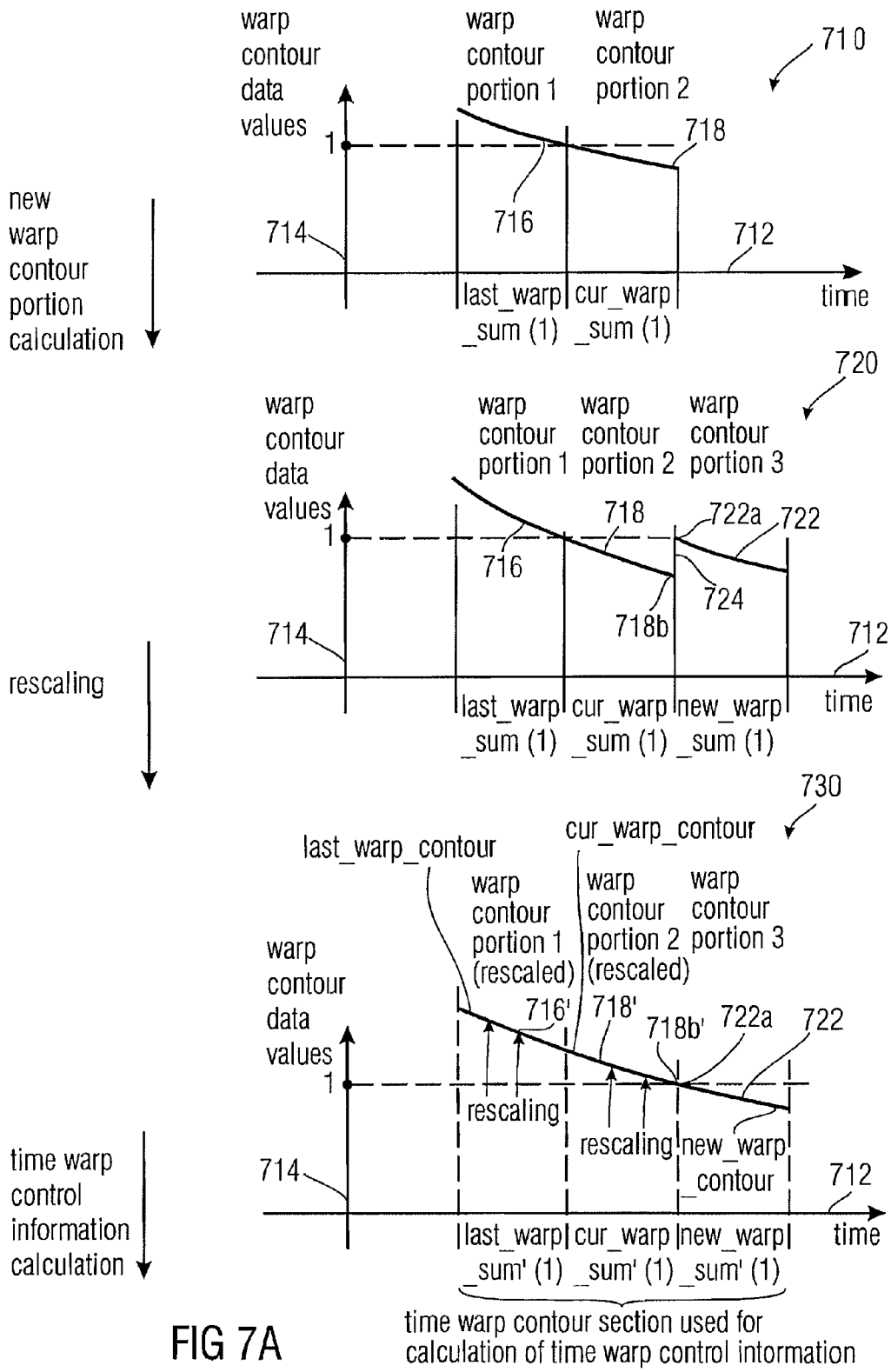
FIGS. 7*a*,7*b* show a graphical representation of a reconstruction of a time warp contour, according to an embodiment of the invention.

It will be assumed that an initial state is present, which is illustrated in a graphical representation 710 of FIG. 7*a*. As can be seen, a first warp contour portion 716 (warp contour portion 1) and a second warp contour portion 718 (warp contour portion 2) are present. Each of the warp contour portions typically comprises a plurality of discrete warp contour data values, which are typically stored in a memory. The different warp contour data values are associated with time values, wherein a time is shown at an abscissa 712. A magnitude of the warp contour data values is shown at an ordinate 714. As can be seen, the first warp contour portion has an end value of 1, and the second warp contour portion has a start value of 1, wherein the value of 1 can be considered as a "predetermined value". It should be noted that the first warp contour portion 716 can be considered as a "last time warp contour portion" (also designated as "last_warp_contour"), while the second warp contour portion 718 can be considered as a "current time warp contour portion" (also referred to as "cur_warp_contour").

Starting from the initial state, a new warp contour portion is calculated, for example, in the steps 610, 620 of the method 600. Accordingly, warp contour data values of the third warp contour portion (also designated as "warp contour portion 3" or "new time warp contour portion" or "new_warp_contour") is calculated. The calculation may, for example, be separated in a calculation of warp node values, according to an algorithm 910 shown in FIG. 9*a*, and an interpolation 620 between the warp node values, according to an algorithm 920 shown in FIG. 9*a*. Accordingly, a new warp contour portion 722 is obtained, which starts from the predetermined value (for example 1) and which is shown in a graphical representation 720 of FIG. 7*a*. As can be seen, the first time warp contour portion 716, the second time warp contour portion 718 and the third new time warp contour portion are associated with subsequent and contiguous time intervals. Further, it can be seen that there is a discontinuity 724 between an end point 718*b* of the second time warp contour portion 718 and a start point 722*a* of the third time warp contour portion.

It should be noted here that the discontinuity 724 typically comprises a magnitude which is larger than a variation between any two temporally adjacent warp contour data values of the time warp contour within a time warp contour portion. This is due to the fact that the start value 722*a* of the third time warp contour portion 722 is forced to the predetermined value (e.g. 1), independent from the end value 718*b* of the second time warp contour portion 718. It should be noted that the discontinuity 724 is therefore larger than the unavoidable variation between two adjacent, discrete warp contour data values.

Nevertheless, this discontinuity between the second time warp contour portion 718 and the third time warp contour portion 722 would be detrimental for the further use of the time warp contour data values.

Accordingly, the first time warp contour portion and the second time warp contour portion are jointly resealed in the step 630 of the method 600. For example, the time warp contour data values of the first time warp contour portion 716 and the time warp contour data values of the second time warp contour portion 718 are resealed by multiplication with a resealing factor (also designated as "norm_fac"). Accordingly, a resealed version 716' of the first time warp contour portion 716 is obtained, and also a resealed version 718' of the second time warp contour portion 718 is obtained. In contrast, the third time warp contour portion is typically left unaffected in this resealing step, as can be seen in a graphical representation 730 of FIG. 7*a*. Resealing can be performed such that the resealed end point 718*b*' comprises, at least approximately, the same data value as the start point 722*a* of the third time warp contour portion 722. Accordingly, the resealed version 716' of the first time warp contour portion, the resealed version 718' of the second time warp contour portion and the third time warp contour portion 722 together form an (approximately) continuous time warp contour section. In particular, the scaling can be performed such that a difference between the data value of the rescaled end point 718*b*' and the start point 722*a* is not larger than a maximum of the difference between any two adjacent data values of the time warp contour portions 716', 718',722.

Accordingly, the approximately continuous time warp contour section comprising the rescaled time warp contour portions 716', 718' and the original time warp contour portion 722 is used for the calculation of the time warp control information, which is performed in the step 640. For example, time warp control information can be computed for an audio frame temporally associated with the second time warp contour portion 718.

However, upon calculation of the time warp control information in the step 640, a time-warped signal reconstruction can be performed in a step 650, which will be explained in more detail below.

Subsequently, it is necessitated to obtain time warp control information for a next audio frame. For this purpose, the rescaled version 716' of the first time warp contour portion may be discarded to save memory, because it is not needed anymore. However, the rescaled version 716' may naturally also be saved for any purpose. Moreover, the rescaled version 718' of the second time warp contour portion takes the place of the "last time warp contour portion" for the new calculation, as can be seen in a graphical representation 740 of FIG. 7*b*. Further, the third time warp contour portion 722, which took the place of the "new time warp contour portion" in the previous calculation, takes the role of the "current time warp contour portion" for a next calculation. The association is shown in the graphical representation 740.

Subsequent to this update of the memory (step 660 of the method 600), a new time warp contour portion 752 is calculated, as can be seen in the graphical representation 750. For this purpose, steps 610 and 620 of the method 600 may be re-executed with new input data. The fourth time warp contour portion 752 takes over the role of the "new time warp contour portion" for now. As can be seen, there is typically a discontinuity between an end point 722*b* of the third time warp contour portion and a start point 752*a* of the fourth time warp contour portion 752. This discontinuity 754 is reduced or eliminated by a subsequent rescaling (step 630 of the method 600) of the resealed version 718' of the second time warp contour portion and of the original version of the third time warp contour portion 722. Accordingly, a twice-rescaled version 718" of the second time warp contour portion and a once rescaled version 722' of the third time warp contour portion are obtained, as can be seen from a graphical representation 760 of FIG. 7*b*. As can be seen, the time warp contour portions 718", 722', 752 form an at least approximately continuous time warp contour section, which can be used for the calculation of time warp control information in a re-execution of the step 640. For example, a time warp control information can be calculated on the basis of the time warp contour portions 718", 722', 752, which time warp control information is associated to an audio signal time frame centered on the second time warp contour portion.

It should be noted that in some cases it is desirable to have an associated warp contour sum value for each of the time warp contour portions. For example, a first warp contour sum value may be associated with the first time warp contour portion, a second warp contour sum value may be associated with the second time warp contour portion, and so on. The warp contour sum values may, for example, be used for the calculation of the time warp control information in the step 640.

For example, the warp contour sum value may represent a sum of the warp contour data values of a respective time warp contour portion. However, as the time warp contour portions are scaled, it is sometimes desirable to also scale the time warp contour sum value, such that the time warp contour sum value follows the characteristic of its associated time warp contour portion. Accordingly, a warp contour sum value associated with the second time warp contour portion 718 may be scaled (for example by the same scaling factor) when the second time warp contour portion 718 is scaled to obtain the scaled version 718' thereof. Similarly, the warp contour sum value associated with the first time warp contour portion 716 may be scaled (for example with the same scaling factor) when the first time warp contour portion 716 is scaled to obtain the scaled version 716' thereof, if desired.

Further, a re-association (or memory re-allocation) may be performed when proceeding to the consideration of a new time warp contour portion. For example, the warp contour sum value associated with the scaled version 718' of the second time warp contour portion, which takes the role of a "current time warp contour sum value" for the calculation of the time warp control information associated with the time warp contour portions 716', 718', 722 may be considered as a "last time warp sum value" for the calculation of a time warp control information associated with the time warp contour portions 718", 722', 752. Similarly, the warp contour sum value associated with the third time warp contour portion 722 may be considered as a "new warp contour sum value" for the calculation of the time warp control information associated with time warp contour portions 716', 718', 722 and may be mapped to act as a "current warp contour sum value" for the calculation of the time warp control information associated with the time warp contour portions 718", 722', 752. Further, the newly calculated warp contour sum value of the fourth time warp contour portion 752 may take the role of the "new warp contour sum value" for the calculation of the time warp control information associated with the time warp contour portions 718", 722', 752.

Figure 8:
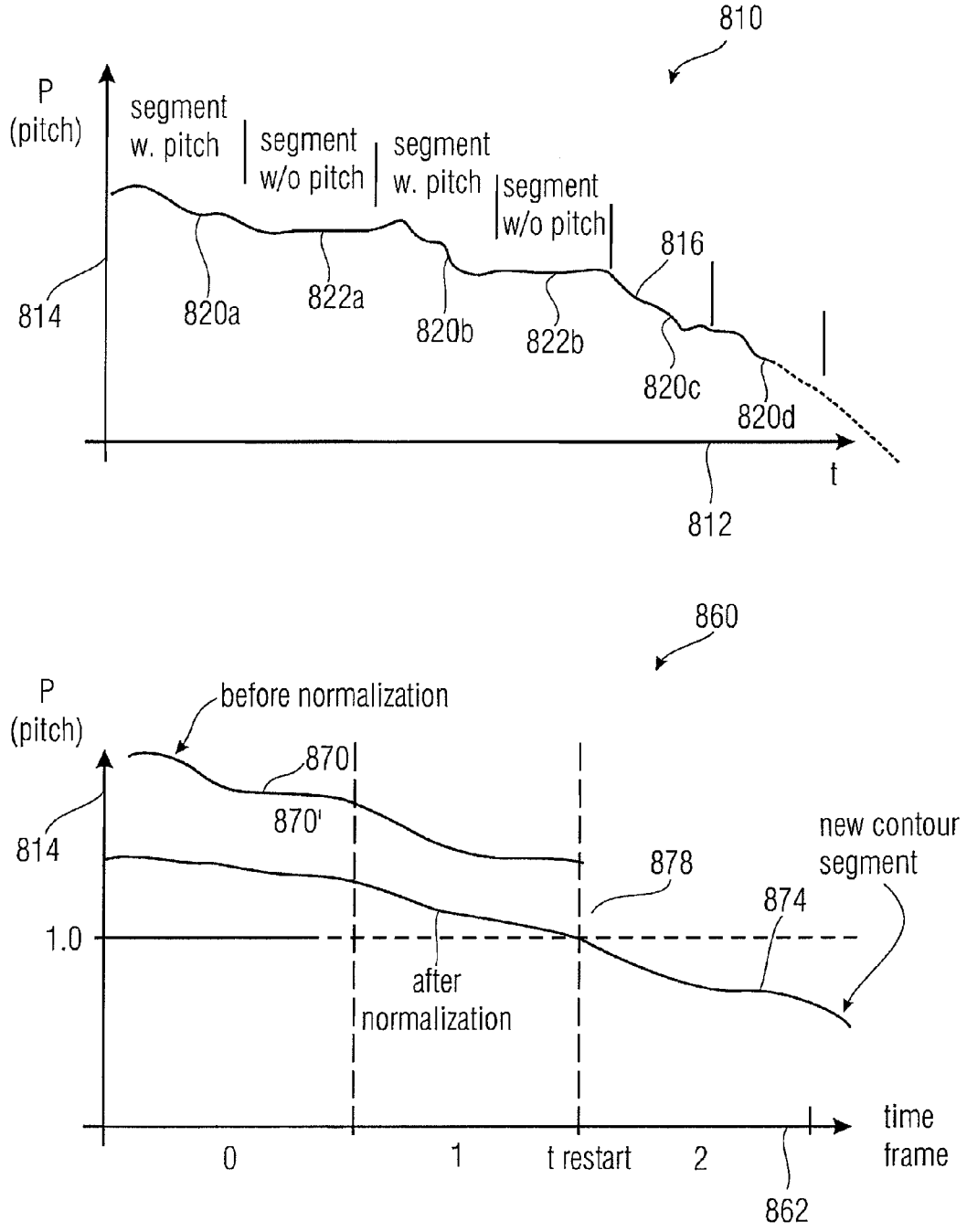
FIG. 8 shows another graphical representation of a reconstruction of a time warp contour, according to an embodiment of the invention.

Example According to FIG. 8

FIG. 8 shows a graphical representation illustrating a problem which is solved by the embodiments according to the invention. A first graphical representation 810 shows a temporal evolution of a reconstructed relative pitch over time, which is obtained in some conventional embodiments. An abscissa 812 describes the time, an ordinate 814 describes the relative pitch. A curve 816 shows the temporal evolution of the relative pitch over time, which could be reconstructed from a relative pitch information. Regarding the reconstruction of the relative pitch contour, it should be noted that for the application of the time warped modified discrete cosine transform (MDCT) only the knowledge of the relative variation of the pitch within the actual frame is necessitated. In order to understand this, reference is made to the calculation steps for obtaining the time contour from the relative pitch contour, which lead to an identical time contour for scaled versions of the same relative pitch contour. Therefore, it is sufficient to only encode the relative instead of an absolute pitch value, which increases the coding efficiency. To further increase the efficiency, the actual quantized value is not the relative pitch but the relative change in pitch, i.e., the ratio of the current relative pitch over the previous relative pitch (as will be discussed in detail in the following). In some frames, where, for example, the signal exhibits no harmonic structure at all, no time warping might be desired. In such cases, an additional flag may optionally indicate a flat pitch contour instead of coding this flat contour with the afore mentioned method. Since in real world signals the amount of such frames is typically high enough, the trade-off between the additional bit added at all times and the bits saved for non-warped frames is in favor of the bit savings.

The start value for the calculation of the pitch variation (relative pitch contour, or time warp contour) can be chosen arbitrary and even differ in the encoder and decoder. Due to the nature of the time warped MDCT (TW-MDCT) different start values of the pitch variation still yield the same sample positions and adapted window shapes to perform the TW-MDCT.

For example, an (audio) encoder gets a pitch contour for every node which is expressed as actual pitch lag in samples in conjunction with an optional voiced/unvoiced specification, which was, for example, obtained by applying a pitch estimation and voiced/unvoiced decision known from speech coding. If for the current node the classification is set to voiced, or no voiced/unvoiced decision is available, the encoder calculates the ratio between the actual pitch lag and quantizes it, or just sets the ratio to 1 if unvoiced. Another example might be that the pitch variation is estimated directly by an appropriate method (for example signal variation estimation).

In the decoder, the start value for the first relative pitch at the start of the coded audio is set to an arbitrary value, for example to 1. Therefore, the decoded relative pitch contour is no longer in the same absolute range of the encoder pitch contour, but a scaled version of it. Still, as described above, the TW-MDCT algorithm leads to the same sample positions and window shapes. Furthermore, the encoder might decide, if the encoded pitch ratios would yield a flat pitch contour, not to send the fully coded contour, but set the activePitchData flag to 0 instead, saving bits in this frame (for example saving numPitchbits*numPitches bits in this frame).

In the following, the problems will be discussed which occur in the absence of the inventive pitch contour renormalization. As mentioned above, for the TW-MDCT, only the relative pitch change within a certain limited time span around the current block is needed for the computation of the time warping and the correct window shape adaptation (see the explanations above). The time warping follows the decoded contour for segments where a pitch change has been detected, and stays constant in all other cases (see the graphical representation 810 of FIG. 8). For the calculation of the window and sampling positions of one block, three consecutive relative pitch contour segments (for example three time warp contour portions) are needed, wherein the third one is the one newly transmitted in the frame (designated as "new time warp contour portion") and the other two are buffered from the past (for example designated as "last time warp contour portion" and "current time warp contour portion").

Figure 7B:
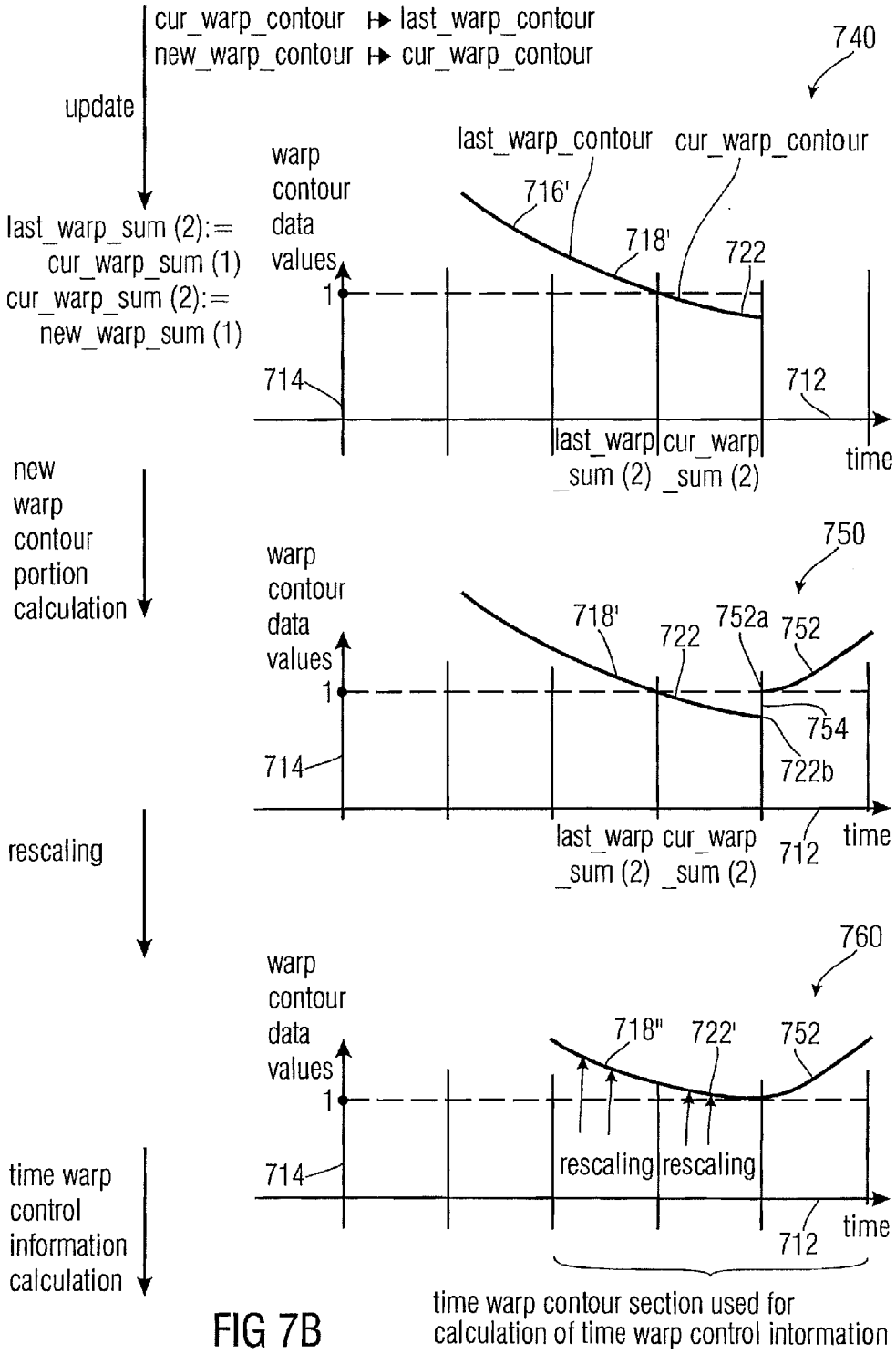

To get an example, reference is made, for example, to the explanations which were made with reference to FIGS. 7*a* and 7*b*, and also to the graphical representations 810, 860 of FIG. 8. To calculate, for example, the sampling, positions of the window for (or associated with) frame 1, which extends from frame 0 to frame 2, the pitch contours of (or associated with) frame 0, 1 and 2 are needed. In the bit stream, only the pitch information for frame 2 is sent in the current frame, and the two others are taken from the past. As explained herein, the pitch contour can be continued by applying the first decoded relative pitch ratio to the last pitch of frame 1 to obtain the pitch at the first node of frame 2, and so on. It is now possible, due to the nature of the signal, that if the pitch contour is simply continued (i.e., if the newly transmitted part of the contour is attached to the existing two parts without any modification), that a range overflow in the coder's internal number format occurs after a certain time. For example, a signal might start with a segment of strong harmonic characteristics and a high pitch value at the beginning which is decreasing throughout the segment, leading to a decreasing relative pitch. Then, a segment with no pitch information can follow, so that the relative pitch keeps constant. Then again, a harmonic section can start with an absolute pitch that is higher than the last absolute pitch of the previous segment, and again going downwards. However, if one simply continues the relative pitch, it is the same as at the end of the last harmonic segment and will go down further, and so on. If the signal is strong enough and has in its harmonic segments an overall tendency to go either up or down (like shown in the graphical representation 810 of FIG. 8), sooner or later the relative pitch reaches the border of a range of the internal number format. It is well known from speech coding that speech signals indeed exhibit such a characteristic. Therefore it comes as no surprise, that the encoding of a concatenated set of real world signals including speech actually exceeded the range of the float values used for the relative pitch after a relatively short amount of time when using the conventional method described above.

To summarize, for an audio signal segment (or frame) for which a pitch can be determined, an appropriate evolution of the relative pitch contour (or time warp contour) could be determined. For audio signal segments (or audio signal frames) for which a pitch cannot be determined (for example because the audio signal segments are noise-like) the relative pitch contour (or time warp contour) could be kept constant. Accordingly, if there was an imbalance between audio segments with increasing pitch and decreasing pitch, the relative pitch contour (or time warp contour) would either run into a numeric underflow or a numeric overflow.

For example, in the graphical representation 810 a relative pitch contour is shown for the case that there is a plurality of relative pitch contour portions 820*a*, 820*a*, 820*c*, 820*d* with decreasing pitch and some audio segments 822*a*, 822*b* without pitch, but no audio segments with increasing pitch. Accordingly, it can be seen that the relative pitch contour 816 runs into a numeric underflow (at least under very adverse circumstances).

In the following, a solution for this problem will be described. To prevent the above-mentioned problems, in particular the numeric underflow or overflow, a periodic relative pitch contour renormalization has been introduced according to an aspect of the invention. Since the calculation of the warped time contour and the window shapes only rely on the relative change over the aforementioned three relative pitch contour segments (also designated as "time warp contour portions"), as explained herein, it is possible to normalize this contour (for example, the time warp contour, which may be composed of three pieces of "time warp contour portions") for every frame (for example of the audio signal) anew with the same outcome.

For this, the reference was, for example, chosen to be the last sample of the second contour segment (also designated as "time warp contour portion"), and the contour is now normalized (for example, multiplicatively in the linear domain) in such a way so that this sample has a value of a 1.0 (see the graphical representation 860 of FIG. 8).

The graphical representation 860 of FIG. 8 represents the relative pitch contour normalization. An abscissa 862 shows the time, subdivided in frames (frames 0, 1, 2). An ordinate 864 describes the value of the relative pitch contour.

A relative pitch contour before normalization is designated with 870 and covers two frames (for example frame number 0 and frame number 1). A new relative pitch contour segment (also designated as "time warp contour portion") starting from the predetermined relative pitch contour starting value (or time warp contour starting value) is designated with 874. As can be seen, the restart of the new relative pitch contour segment 874 from the predetermined relative pitch contour starting value (e.g. 1) brings along a discontinuity between the relative pitch contour segment 870 preceding the restart point-in-time and the new relative pitch contour segment 874, which is designated with 878. This discontinuity would bring along a severe problem for the derivation of any time warp control information from the contour and will possibly result in audio distortions. Therefore, a previously obtained relative pitch contour segment 870 preceding the restart point-in-time restart is resealed (or normalized), to obtain a resealed relative pitch contour segment 870'. The normalization is performed such that the last sample of the relative pitch contour segment 870 is scaled to the predetermined relative pitch contour start value (e.g. of 1.0).

DETAILED DESCRIPTION OF THE ALGORITHM

In the following, some of the algorithms performed by an audio decoder according to an embodiment of the invention will be described in detail. For this purpose, reference will be made to FIGS. 5, 6, 9*a*, 9*b*, 9*c* and 10*a*-10*g*. Further, reference is made to the legend of data elements, help elements and constants of FIGS. 11*a* and 11*b*.

Generally speaking, it can be said that the method described here can be used for decoding an audio stream which is encoded according to a time warped modified discrete cosine transform. Thus, when the TW-MDCT is enabled for the audio stream (which may be indicated by a flag, for example referred to as "twMdct" flag, which may be comprised in a specific configuration information), a time warped filter bank and block switching may replace a standard filter bank and block switching. Additionally to the inverse modified discrete cosine transform (IMDCT) the time warped filter bank and block switching contains a time domain to time domain mapping from an arbitrarily spaced time grid to the normal regularly spaced time grid and a corresponding adaptation of window shapes.

In the following, the decoding process will be described. In a first step, the warp contour is decoded. The warp contour may be, for example, encoded using codebook indices of warp contour nodes. The codebook indices of the warp contour nodes are decoded, for example, using the algorithm shown in a graphical representation 910 of FIG. 9*a*. According to said algorithm, warp ratio values (warp_value_tbl) are derived from warp ratio codebook indices (tw_ratio), for example using a mapping defined by a mapping table 990 of FIG. 9*c*. As can be seen from the algorithm shown as reference numeral 910, the warp node values may be set to a constant predetermined value, if a flag (tw_data_present) indicates that time warp data is not present. In contrast, if the flag indicates that time warp data is present, a first warp node value can be set to the predetermined time warp contour starting value (e.g. 1). Subsequent warp node values (of a time warp contour portion) can be determined on the basis of a formation of a product of multiple time warp ratio values. For example, a warp node value of a node immediately following the first warp node (i=0) may be equal to a first warp ratio value (if the starting value is 1) or equal to a product of the first warp ratio value and the starting value. Subsequent time warp node values (i=2, 3, . . . , num_tw_nodes) are computed by forming a product of multiple time warp ratio values (optionally taking into consideration the starting value, if the starting value differs from 1). Naturally, the order of the product formation is arbitrary. However, it is advantageous to derive a (i+1)-th warp mode value from an i-th warp node value by multiplying the i-th warp node value with a single warp ratio value describing a ratio between two subsequent node values of the time warp contour.

As can be seen from the algorithm shown at reference numeral 910, there may be multiple warp ratio codebook indices for a single time warp contour portion over a single audio frame (wherein there may be a 1-to-1 correspondence between time warp contour portions and audio frames).

To summarize, a plurality of time warp node values can be obtained for a given time warp contour portion (or a given audio frame) in the step 610, for example using the warp node value calculator 544. Subsequently, a linear interpolation can be performed between the time warp node values (warp_node_values[i]). For example, to obtain the time warp contour data values of the "new time warp contour portion" (new_warp_contour) the algorithm shown at reference numeral 920 in FIG. 9*a* can be used. For example, the number of samples of the new time warp contour portion is equal to half the number of the time domain samples of an inverse modified discrete cosine transform. Regarding this issue, it should be noted that adjacent audio signal frames are typically shifted (at least approximately) by half the number of the time domain samples of the MDCT or IMDCT. In other words, to obtain the sample-wise (N_long samples) new_warp_contour[ ], the warp_node_values[ ] are interpolated linearly between the equally spaced (interp_dist apart) nodes using the algorithm shown at reference numeral 920.

The interpolation may, for example, be performed by the interpolator 548 of the apparatus of FIG. 5, or in the step 620 of the algorithm 600.

Before obtaining the full warp contour for this frame (i.e. for the frame presently under consideration) the buffered values from the past are rescaled so that the last warp value of the past_warp_contour[ ] equals 1 (or any other predetermined value, which my be equal to the starting value of the new time warp contour portion).

It should be noted here that the term "past warp contour" may comprise the above-described "last time warp contour portion" and the above-described "current time warp contour portion". It should also be noted that the "past warp contour" typically comprises a length which is equal to a number of time domain samples of the IMDCT, such that values of the "past warp contour" are designated with indices between 0 and 2*n_long-1. Thus, "past_warp_contour[2*n_long-1]" designates a last warp value of the "past warp contour". Accordingly, a normalization factor "norm_fac" can be calculated according to an equation shown at reference numeral 930 in FIG. 9*a*. Thus, the past warp contour (comprising the "last time warp contour portion" and the "current time warp contour portion") can be multiplicatively rescaled according to the equation shown at reference numeral 932 in FIG. 9*a*. In addition, the "last warp contour sum value" (last_warp_sum) and the "current warp contour sum value" (cur_warp_sum) can be multiplicatively rescaled, as shown in reference numerals 934 and 936 in FIG. 9*a*. The rescaling can be performed by the rescaler 550 of FIG. 5, or in step 630 of the method 600 of FIG. 6.

It should be noted that the normalization described here, for example at reference numeral 930, then could be modified, for example, by replacing the starting value of "1" by any other desired predetermined value.

By applying the normalization, a "full warp_contour[ ]" also designated as a "time warp contour section" is obtained by concatenating the "past_warp_contour" and the "new_warp_contour". Thus, three time warp contour portions ("last time warp contour portion", "current time warp contour portion", and "new time warp contour portion") form the "full warp contour", which may be applied in further steps of the calculation.

In addition, a warp contour sum value (new_warp_sum) is calculated, for example, as a sum over all "new_warp_contour[ ]" values. For example, a new warp contour sum value can be calculated according to the algorithms shown at reference numeral 940 in FIG. 9*a*.

Following the above-described calculations, the input information needed by the time warp control information calculator 330 or by the step 640 of the method 600 is available. Accordingly, the calculation 640 of the time warp control information can be performed, for example by the time warp control information calculator 530. Also, the time warped signal reconstruction 650 can be performed by the audio decoder. Both, the calculation 640 and the time-warped signal reconstruction 650 will be explained in more detail below.

However, it is important to note that the present algorithm proceeds iteratively. It is therefore computationally efficient to update a memory. For example, it is possible to discard information about the last time warp contour portion. Further, it is recommendable to use the present "current time warp contour portion" as a "last time warp contour portion" in a next calculation cycle. Further, it is recommendable to use the present "new time warp contour portion" as a "current time warp contour portion" in a next calculation cycle. This assignment can be made using the equation shown at reference numeral 950 in FIG. 9*b*, (wherein warp_contour[n] describes the present "new time warp contour portion" for $2*n_long \leq n \leq 3 \cdot n_long$).

Appropriate assignments can be seen at reference numerals 952 and 954 in FIG. 9*b*.

In other words, memory buffers used for decoding the next frame can be updated according to the equations shown at reference numerals 950, 952 and 954.

It should be noted that the update according to the equations 950, 952 and 954 does not provide a reasonable result, if the appropriate information is not being generated for a previous frame. Accordingly, before decoding the first frame or if the last frame was encoded with a different type of coder (for example a LPC domain coder) in the context of a switched coder, the memory states may be set according to the equations shown at reference numerals 960, 962 and 964 of FIG. 9*b*.

Calculation of Time Warp Control Information

In the following, it will be briefly described how the time warp control information can be calculated on the basis of the time warp contour (comprising, for example, three time warp contour portions) and on the basis of the warp contour sum values.

Figure 12:
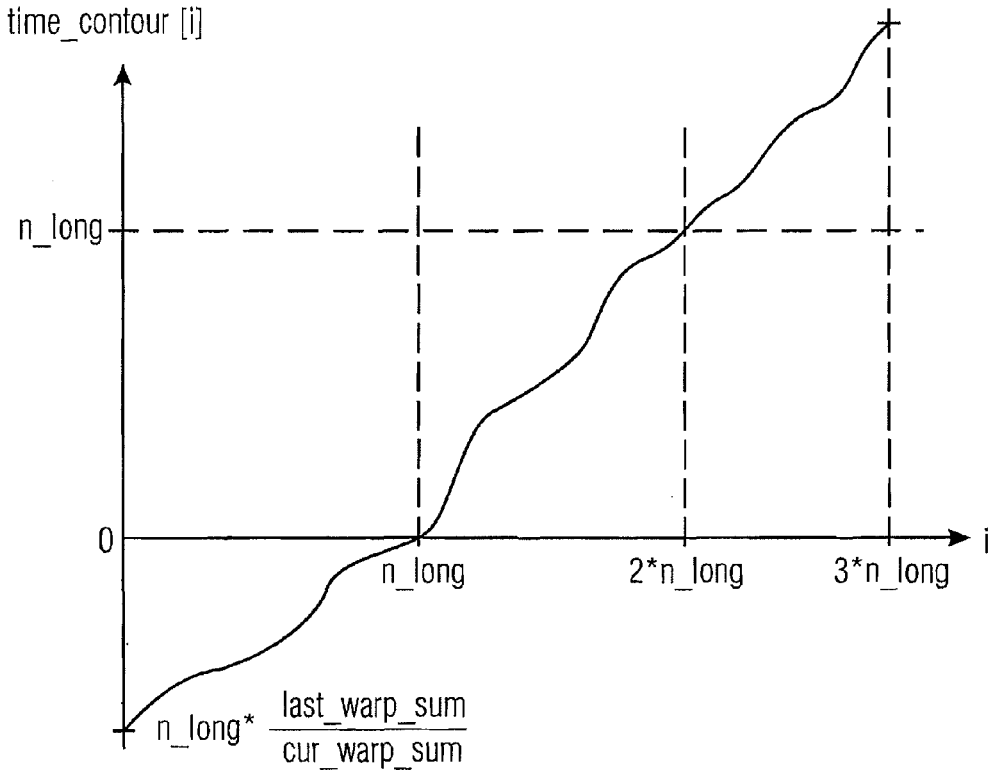
FIG. 12 shows a graphical representation of a time contour, which can be extracted from a time warp contour.

For example, it is desired to reconstruct a time contour using the time warp contour. For this purpose, an algorithm can be used which is shown at reference numerals 1010, 1012 in FIG. 10*a*. As can be seen, the time contour maps an index i ($0 \leq i \leq 3 \cdot n_long$) onto a corresponding time contour value. An example of such a mapping is shown in FIG. 12.

Based on the calculation of the time contour, it is typically necessitated to calculate a sample position (sample_pos[ ]), which describes positions of time warped samples on a linear time scale. Such a calculation can be performed using an algorithm, which is shown at reference numeral 1030 in FIG. 10*b*. In the algorithm 1030, helper functions can be used, which are shown at reference numerals 1020 and 1022 in FIG. 10*a*. Accordingly, an information about the sample time can be obtained.

Furthermore, some lengths of time warped transitions (warped_trans_len_left; warped_trans_len_right) are calculated, for example using an algorithm 1032 shown in FIG. 10*b*. Optionally, the time warp transition lengths can be adapted dependent on a type of window or a transform length, for example using an algorithm shown at reference numeral 1034 in FIG. 10*b*. Furthermore, a so-called "first position" and a so-called "last position" can be computed on the basis of the transition lengths informations, for example using an algorithm shown at reference numeral 1036 in FIG. 10*b*. To summarize, a sample positions and window lengths adjustment, which may be performed by the apparatus 530 or in the step 640 of the method 600 will be performed. From the "warp_contour[ ]" a vector of the sample positions ("sample_pos[ ]") of the time warped samples on a linear time scale may be computed. For this, first the time contour may be generated using the algorithm shown at reference numerals 1010, 1012. With the helper functions "warp_in_vec( )" and "warp_time_inv( )", which are shown at reference numerals 1020 and 1022, the sample position vector ("sample_pos[ ]") and the transition lengths ("warped_trans_len_left" and "warped_trans_len_right") are computed, for example using the algorithms shown at reference numerals 1030, 1032, 1034 and 1036. Accordingly, the time warp control information 512 is obtained.

Time Warped Signal Reconstruction

In the following, the time warped signal reconstruction, which can be performed on the basis of the time warp control information will be briefly discussed to put the computation of the time warp contour into the proper context.

The reconstruction of an audio signal comprises the execution of an inverse modified discrete cosine transform, which is not described here in detail, because it is well known to anybody skilled in the art. The execution of the inverse modified discrete cosine transform allows to reconstruct warped time domain samples on the basis of a set of frequency domain coefficients. The execution of the IMDCT may, for example, be performed frame-wise, which means, for example, a frame of 2048 warped time domain samples is reconstructed on the basis of a set of 1024 frequency domain coefficients. For the correct reconstruction it is necessitated that no more than two subsequent windows overlap. Due to the nature of the TW-MDCT it might occur that a inversely time warped portion of one frame extends to a non-neighbored frame, thusly violating the prerequisite stated above. Therefore the fading length of the window shape needs to be shortened by calculating the appropriate warped_trans_len_left and warped_trans_len_right values mentioned above.

A windowing and block switching 650*b* is then applied to the time domain samples obtained from the IMDCT. The windowing and block switching may be applied to the warped time domain samples provided by the IMDCT 650*a* in dependence on the time warp control information, to obtain windowed warped time domain samples. For example, depending on a "window shape" information, or element, different oversampled transform window prototypes may be used, wherein the length of the oversampled windows may be given by the equation shown at reference numeral 1040 in FIG. 10*c*. For example, for a first type of window shape (for example window_shape==1), the window coefficients are given by a "Kaiser-Bessel" derived (KBD) window according to the definition shown at reference numeral 1042 in FIG. 10*c*, wherein W', the "Kaiser-Bessel kernel window function", is defined as shown at reference numeral 1044 in FIG. 10*c*.

Otherwise, when using a different window shape is used (for example, if window_shape==0), a sine window may be employed according to the definition a reference numeral 1046. For all kinds of window sequences ("window_sequences"), the used prototype for the left window part is determined by the window shape of the previous block. The formula shown at reference numeral 1048 in FIG. 10*c* expresses this fact. Likewise, the prototype for the right window shape is determined by the formula shown at reference numeral 1050 in FIG. 10*c*.

In the following, the application of the above-described windows to the warped time domain samples provided by the IMDCT will be described. In some embodiments, the information for a frame can be provided by a plurality of short sequences (for example, eight short sequences). In other embodiments, the information for a frame can be provided using blocks of different lengths, wherein a special treatment may be necessitated for start sequences, stop sequences and/or sequences of non-standard lengths. However, since the transitional length may be determined as described above, it may be sufficient to differentiate between frames encoded using eight short sequences (indicated by an appropriate frame type information "eight_short_sequence") and all other frames.

For example, in a frame described by an eight short sequence, an algorithm shown as reference numeral 1060 in FIG. 10*d* may be applied for the windowing. In contrast, for frames encoded using other information, an algorithm is shown at reference numeral 1064 in FIG. 10*e* may be applied. In other words, the C-code like portion shown at reference numeral 1060 in FIG. 10*d* describes the windowing and internal overlap-add of a so-called "eight-short-sequence". In contrast, the C-code-like portion shown in reference numeral 1064 in FIG. 10*d* describes the windowing in other cases.

Resampling

In the following, the inverse time warping 650*c* of the windowed warped time domain samples in dependence on the time warp control information will be described, whereby regularly sampled time domain samples, or simply time domain samples, are obtained by time-varying resampling. In the time-varying resampling, the windowed block z[ ] is resampled according to the sampled positions, for example using an impulse response shown at reference numeral 1070 in FIG. 10*f*. Before resampling, the windowed block may be padded with zeros on both ends, as shown at reference numeral 1072 in FIG. 10*f*. The resampling itself is described by the pseudo code section shown at reference numeral 1074 in FIG. 10*f*.

Post-Resampler Frame Processing

In the following, an optional post-processing 650*d* of the time domain samples will be described. In some embodiments, the post-resampling frame processing may be performed in dependence on a type of the window sequence. Depending on the parameter "window_sequence", certain further processing steps may be applied.

For example, if the window sequence is a so-called "EIGHT_SHORT_SEQUENCE", a so-called "LONG_START_SEQUENCE", a so-called "STOP_START_SEQUENCE", a so-called "STOP_START_1152_SEQUENCE" followed by a so-called LPD_SEQUENCE, a post-processing as shown at reference numerals 1080*a*, 1080*b*, 1082 may be performed.

For example, if the next window sequence is a so-called "LPD_SEQUENCE", a correction window $W_{corr}(n)$ may be calculated as shown at reference numeral 1080*a*, taking into account the definitions shown at reference numeral 1080*b*. Also. The correction window $W_{corr}(n)$ may be applied as shown at reference numeral 1082 in FIG. 10*g*.

For all other cases, nothing may be done, as can be seen at reference numeral 1084 in FIG. 10*g*.

Overlapping and Adding with Previous Window Sequences

Furthermore, an overlap-and-add 650*e* of the current time domain samples with one or more previous time domain samples may be performed. The overlapping and adding may be the same for all sequences and can be described mathematically as shown at reference numeral 1086 in FIG. 10*g*.

Legend

Regarding the explanations given, reference is also made to the legend, which is shown in FIGS. 11*a* and 11*d*. In particular, the synthesis window length N for the inverse transform is typically a function of the syntax element "window sequence" and the algorithmic context. It may for example be defined as shown at reference numeral 1190 of FIG. 11*b*.

Figure 13:
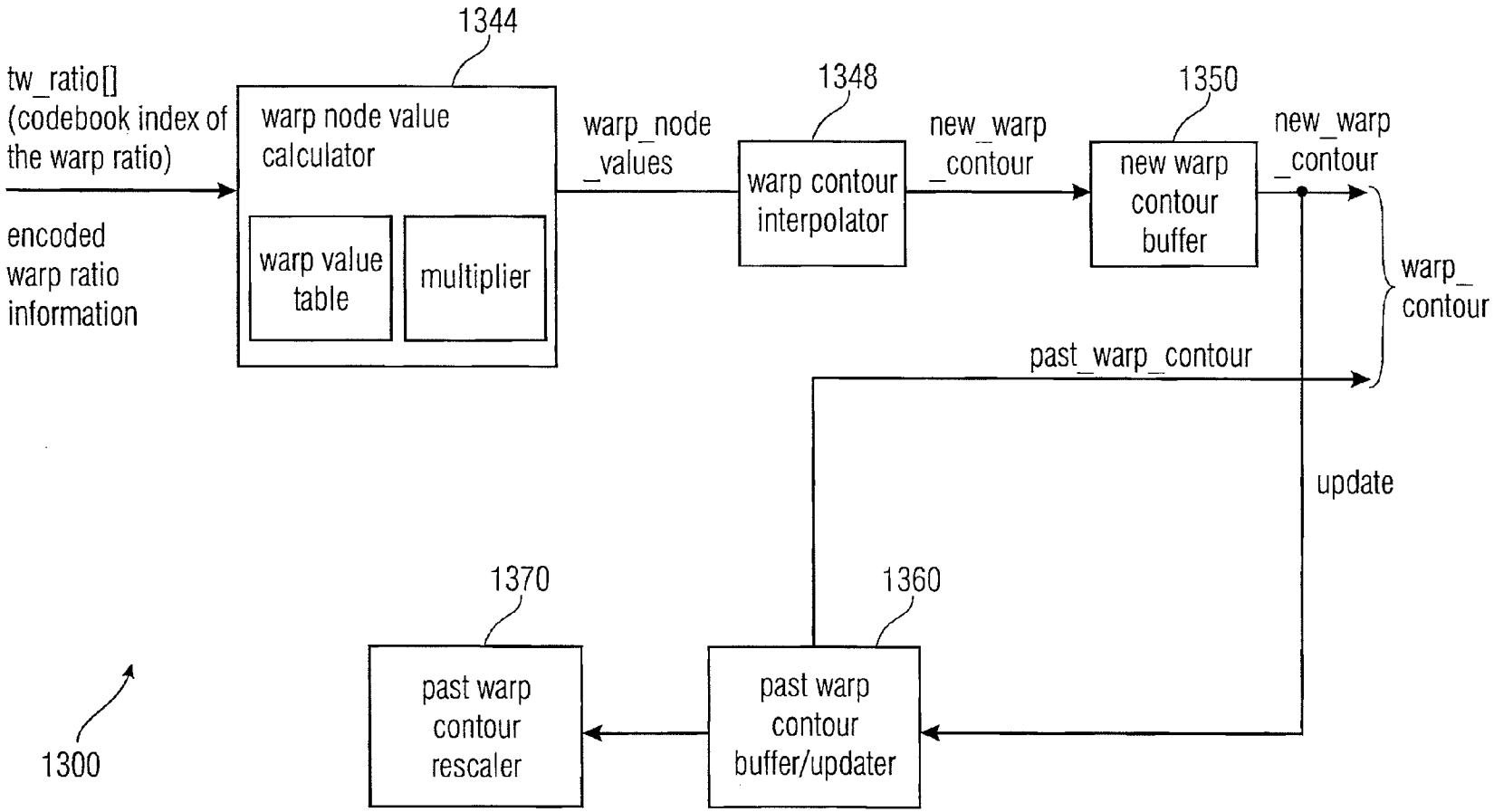
FIG. 13 shows a detailed block schematic diagram of an apparatus for providing a warp contour, according to an embodiment of the invention.

Embodiment According to FIG. 13

FIG. 13 shows a block schematic diagram of a means 1300 for providing a reconstructed time warp contour information which takes over the functionality of the means 520 described with reference to FIG. 5. However, the data path and the buffers are shown in more detail. The means 1300 comprises a warp node value calculator 1344, which takes the function of the warped node value calculator 544. The warp node value calculator 1344 receives a codebook index "tw_ratio[ ]" of the warp ratio as an encoded warp ratio information. The warp node value calculator comprises a warp value table representing, for example, the mapping of a time warp ratio index onto a time warp ratio value represented in FIG. 9*c*. The warp node value calculator 1344 may further comprise a multiplier for performing the algorithm represented at reference numeral 910 of FIG. 9*a*. Accordingly, the warp node value calculator provides warp node values "warp_node_values[i]". Further, the means 1300 comprise a warp contour interpolator 1348, which takes the function of the interpolator 540*a*, and which may be figured to perform the algorithm shown at reference numeral 920 in FIG. 9*a*, thereby obtaining values of the new warp contour ("new_warp_contour"). Means 1300 further comprises a new warp contour buffer 1350, which stores the values of the new warp contour (i.e. warp_contour [i], with $2 \cdot n_long \leq i \leq 3 \cdot n_long$). The means 1300 further comprises a past warp contour buffer/updater 1360, which stores the "last time warp contour portion" and the "current time warp contour portion" and updates the memory contents in response to a rescaling and in response to a completion of the processing of the current frame. Thus, the past warp contour buffer/updater 1360 may be in cooperation with the past warp contour rescaler 1370, such that the past warp contour buffer/updater and the past warp contour rescaler together fulfill the functionality of the algorithms 930, 932, 934, 936, 950, 960. Optionally, the past warp contour buffer/updater 1360 may also take over the functionality of the algorithms 932, 936, 952, 954, 962, 964.

Thus, the means 1300 provides the warp contour ("warp_contour") and optimally also provides the warp contour sum values.

Figure 14:
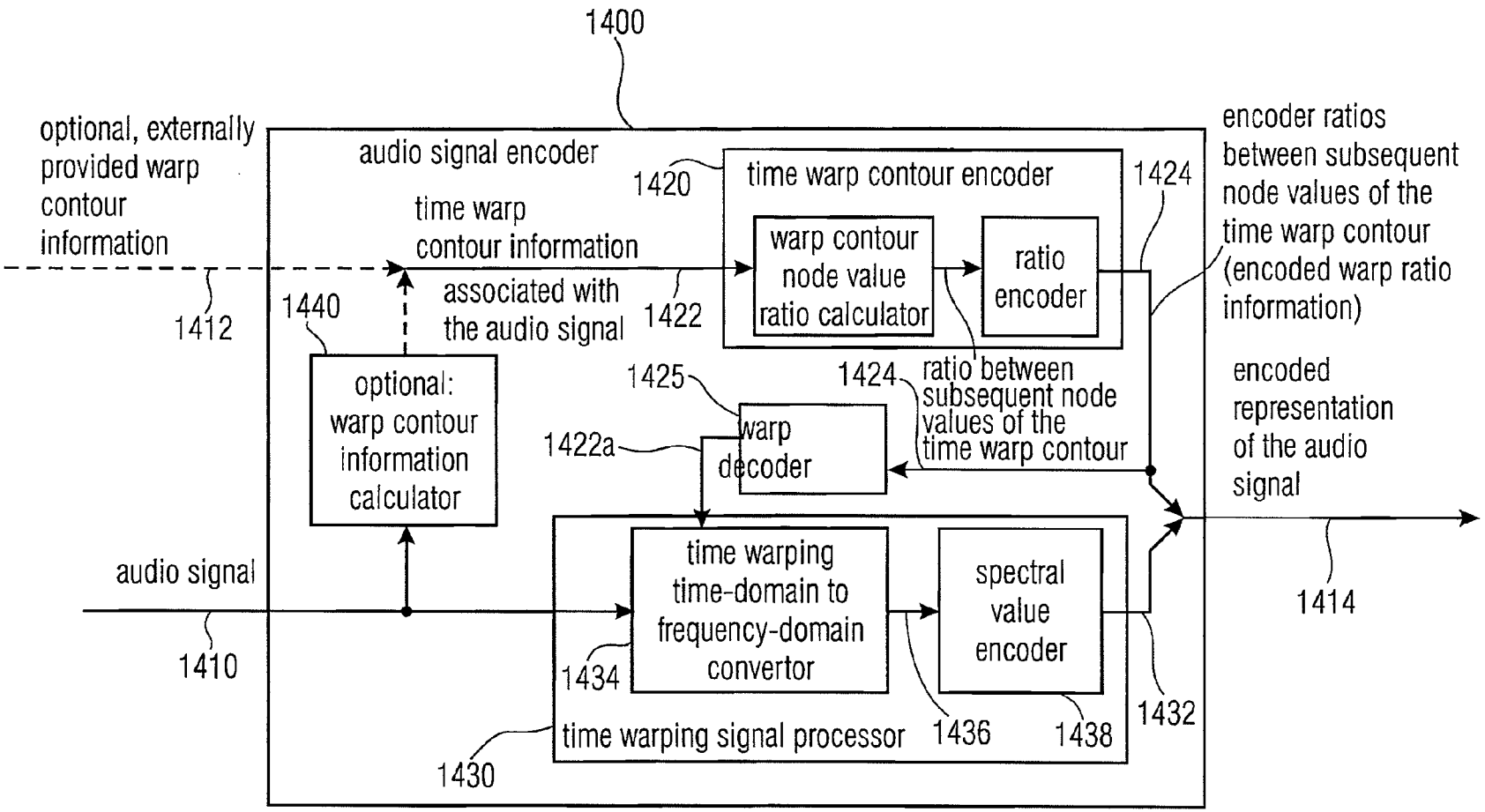
FIG. 14 shows a block schematic diagram of an audio signal decoder, according to another embodiment of the invention.

Audio Signal Encoder According to FIG. 14

In the following, an audio signal encoder according to an aspect of the invention will be described. The audio signal encoder of FIG. 14 is designated in its entirety with 1400. The audio signal encoder 1400 is configured to receive an audio signal 1410 and, optionally, an externally provided warp contour information 1412 associated with the audio signal 1410. Further, the audio signal encoder 1400 is configured to provide an encoded representation 1440 of the audio signal 1410.

The audio signal encoder 1400 comprises a time warp contour encoder 1420, configured to receive a time warp contour information 1422 associated with the audio signal 1410 and to provide an encoded time warp contour information 1424 on the basis thereof.

The audio signal encoder 1400 further comprises a time warping signal processor (or time warping signal encoder) 1430 which is configured to receive the audio signal 1410 and to provide, on the basis thereof, a time-warp-encoded representation 1432 of the audio signal 1410, taking into account a time warp described by the time warp information 1422. The encoded representation 1414 of the audio signal 1410 comprises the encoded time warp contour information 1424 and the encoded representation 1432 of the spectrum of the audio signal 1410.

Optionally, the audio signal encoder 1400 comprises a warp contour information calculator 1440, which is configured to provide the time warp contour information 1422 on the basis of the audio signal 1410. Alternatively, however, the time warp contour information 1422 can be provided on the basis of the externally provided warp contour information 1412.

The time warp contour encoder 1420 may be configured to compute a ratio between subsequent node values of the time warp contour described by the time warp contour information 1422. For example, the node values may be sample values of the time warp contour represented by the time warp contour information. For example, if the time warp contour information comprises a plurality of values for each frame of the audio signal 1410, the time warp node values may be a true subset of this time warp contour information. For example, the time warp node values may be a periodic true subset of the time warp contour values. A time warp contour node value may be present per N of the audio samples, wherein N may be greater than or equal to 2.

The time contour node value ratio calculator may be configured to compute a ratio between subsequent time warp node values of the time warp contour, thus providing an information describing a ratio between subsequent node values of the time warp contour. A ratio encoder of the time warp contour encoder may be configured to encode the ratio between subsequent node values of the time warp contour. For example, the ratio encoder may map different ratios to different code book indices. For example, a mapping may be chosen such that the ratios provided by the time contour warp value ratio calculator are within a range between 0.9 and 1.1, or even between 0.95 and 1.05. Accordingly, the ratio encoder may be configured to map this range to different codebook indices. For example, correspondences shown in the table of FIG. 9*c* may act as supporting points in this mapping, such that, for example, a ratio of 1 is mapped onto a codebook index of 3, while a ratio of 1.0057 is mapped to a codebook index of 4, and so on (compare FIG. 9*c*). Ratio values between those shown in the table of FIG. 9*c* may be mapped to appropriate codebook indices, for example to the codebook index of the nearest ratio value for which the codebook index is given in the table of FIG. 9*c*.

Naturally, different encodings may be used such that, for example, a number of available codebook indices may be chosen larger or smaller than shown here. Also, the association between warp contour node values and codebook values indices may be chosen appropriately. Also, the codebook indices may be encoded, for example, using a binary encoding, optionally using an entropy encoding.

Accordingly, the encoded ratios 1424 are obtained

The time warping signal processor 1430 comprises a time warping time-domain to frequency-domain converter 1434, which is configured to receive the audio signal 1410 and a time warp contour information 1422*a* associated with the audio signal (or an encoded version thereof), and to provide, on the basis thereof, a spectral domain (frequency-domain) representation 1436.

The time warp contour information 1422*a* may be derived from the encoded information 1424 provided by the time warp contour encoder 1420 using a warp decoder 1425. In this way, it can be achieved that the encoder (in particular the time warping signal processor 1430 thereof) and the decoder (receiving the encoded representation 1414 of the audio signal) operate on the same warp contours, namely the decoded (time) warp contour. However, in a simplified embodiment, the time warp contour information 1422*a* used by the time warping signal processor 1430 may be identical to the time warp contour information 1422 input to the time warp contour encoder 1420.

The time warping time-domain to frequency-domain converter 1434 may, for example, consider a time warp when forming the spectral domain representation 1436, for example using a time-varying resampling operation of the audio signal 1410. Alternatively, however, time-varying resampling and time-domain to frequency-domain conversion may be integrated in a single processing step. The time warping signal processor also comprises a spectral value encoder 1438, which is configured to encode the spectral domain representation 1346. The spectral value encoder 1438 may, for example, be configured to take into consideration perceptual masking. Also, the spectral value encoder 1438 may be configured to adapt the encoding accuracy to the perceptual relevance of the frequency bands and to apply an entropy encoding. Accordingly, the encoded representation 1432 of the audio signal 1410 is obtained.

Figure 15:
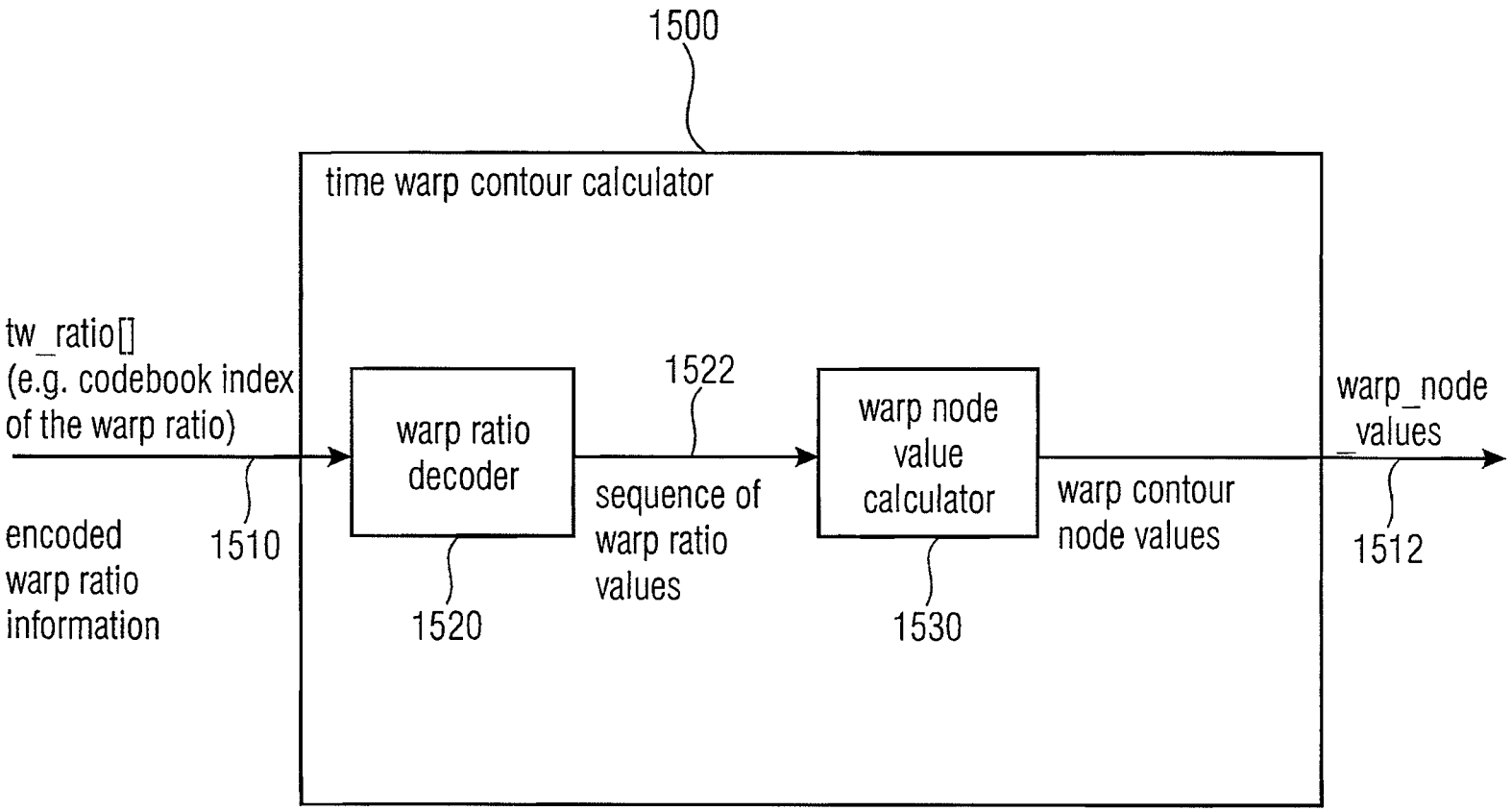
FIG. 15 shows a block schematic diagram of another time warp contour calculator according to an embodiment of the invention.

Time Warp Contour Calculator According to FIG. 15

FIG. 15 shows the block schematic diagram of a time warp contour calculator, according to another embodiment of the invention. The time warp contour calculator 1500 is configured to receive an encoded warp ratio information 1510 to provide, on the basis thereof, a plurality of warp node values 1512. The time warp contour calculator 1500 comprises, for example, a warp ratio decoder 1520, which is configured to derive a sequence of warp ratio values 1522 from the encoded warp ratio information 1510. The time warp contour calculator 1500 also comprises a warp contour calculator 1530, which is configured to derive the sequence of warp node values 1512 from the sequence of warp ratio values 1522. For example, the warp contour calculator may be configured to obtain the warp contour node values starting from a warp contour start value, wherein ratios between the warp contour start value, associated with a warp contour starting node, and the warp contour node values are determined by the warp ratio values 1522. The warp node value calculator is also configured to compute a warp contour node value 1512 of a given warp contour node which is spaced from the warp contour start node by an intermediate warp contour node, on the basis of a product-formation comprising a ratio between the warp contour starting value (for example 1) and the warp contour node value of the intermediate warp contour node and a ratio between the warp contour node value of the intermediate warp contour node and the warp contour node value of the given warp contour node as factors.

In the following, the operation of the time warp contour calculator 1500 will be briefly discussed taking reference to FIGS. 16*a* and 16*b*.

Figure 16A:
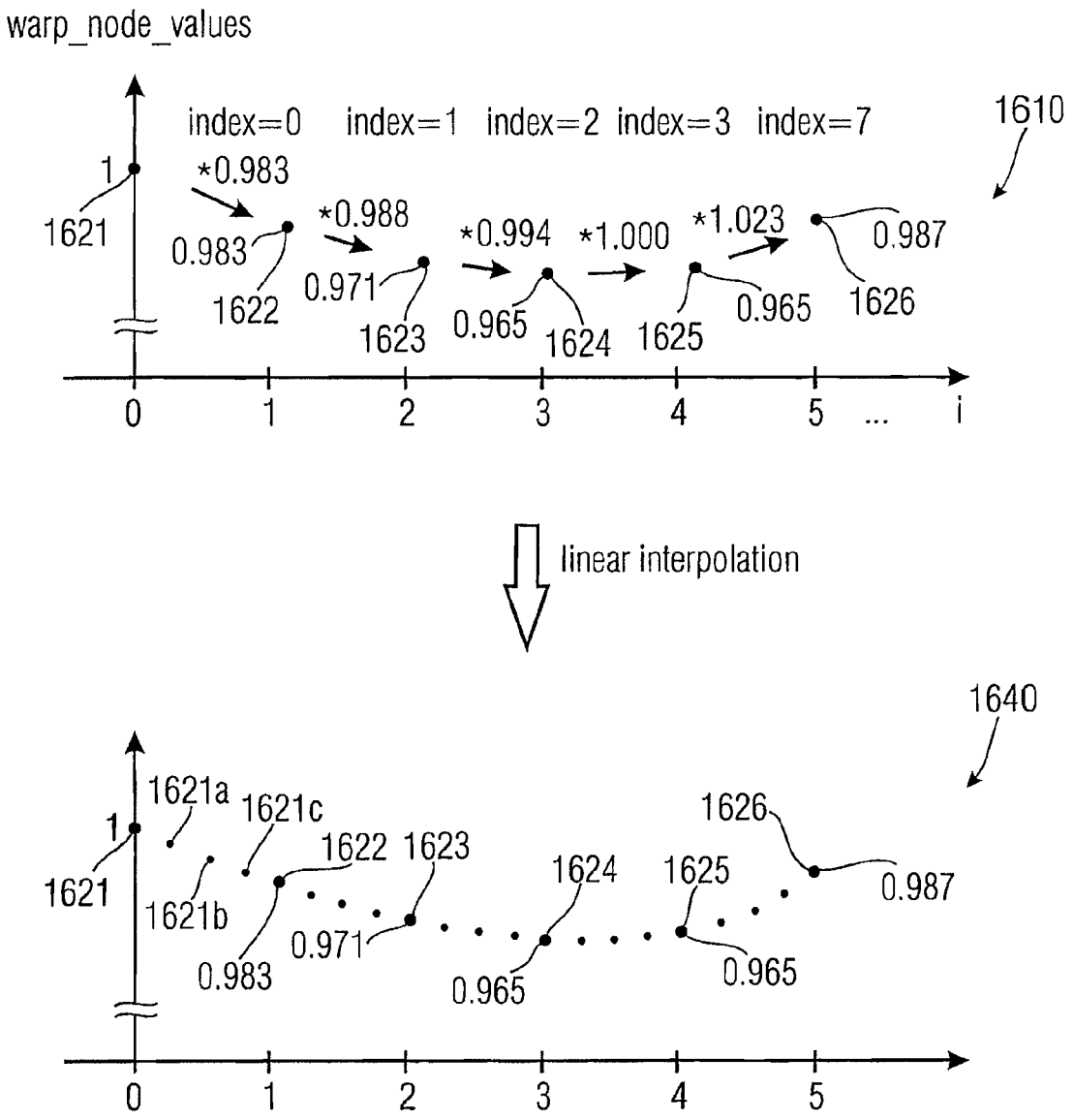
FIGS. 16*a*, 16*b* show a graphical representation of a computation of time warp node values, according to an embodiment of the invention.

FIG. 16*a* shows a graphical representation of a successive calculation of a time warp contour. A first graphical representation 1610 shows a sequence of time warp ratio codebook indices 1510 (index=0, index=1, index=2, index=3, index=7). Further, the graphical representation 1610 shows a sequence of warp ratio values (0.983, 0.988, 0.994, 1.000, 1.023) associated with the codebook indices. Further, it can be seen that a first warped node value 1621 (i=0) is chosen to be 1 (wherein 1 is a starting value). As can be seen, a second warp node value 1622 (i=1) is obtained by multiplying the starting value of 1 with the first ratio value of 0.983 (associated with the first index 0). It can further be seen that the third warp node value 1623 is obtained by multiplying the second warp node value 1622 of 0.983 with the second warp ratio value of 0.988 (associated with the second index of 1). In the same way, the fourth warp node value 1624 is obtained by multiplying the third warp node value 1623 with the third warp ratio value of 0.994 (associated with a third index of 2).

Accordingly, a sequence of warp node values 1621, 1622, 1623, 1624, 1625, 1626 are obtained.

A respective warp node value is effectively obtained such that it is a product of the starting value (for example 1) and all the intermediate warp ratio values lying between the starting warp nodes 1621 and the respective warp node value 1622 to 1626.

A graphical representation 1640 illustrates a linear interpolation between the warp node values. For example, interpolated values 1621*a*, 1621*b*, 1621*c* could be obtained in an audio signal decoder between two adjacent time warp node values 1621, 1622, for example making use of a linear interpolation.

Figure 16B:
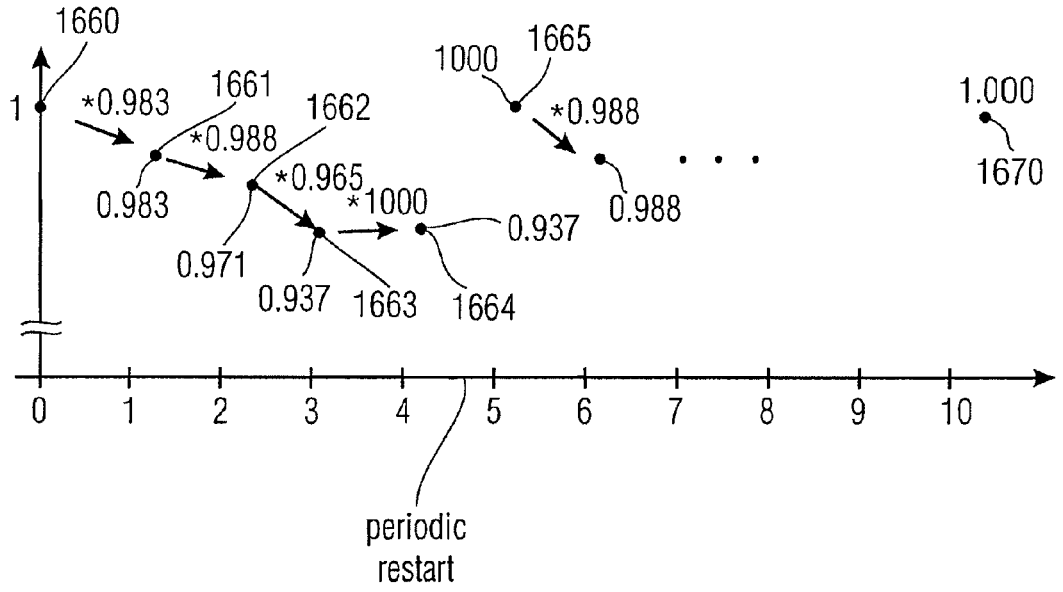

FIG. 16*b* shows a graphical representation of a time warp contour reconstruction using a periodic restart from a predetermined starting value, which can optionally be implemented in the time warp contour calculator 1500. In other words, the repeated or periodic restart is not an essential feature, provided a numeric overflow can be avoided by any other appropriate measure at the encoder side or at the decoder side. As can be seen, a warp contour portion can start from a starting node 1660 wherein warp contour nodes 1661, 1662, 1663, 1664 can be determined. For this purpose, warp ratio values (0.983, 0.988, 0.965, 1.000) can be considered, such that adjacent warp contour nodes 1661 to 1664 of the first time warp contour portion are separated by ratios determined by these warp ratio values. However, a further, second time warp contour portion may be started after an end node 1664 of the first time warp contour portion (comprising nodes 1660-1664) has been reached. The second time warp contour portion may start from a new starting node 1665, which may take the predetermined starting value, independent from any warp ratio values. Accordingly, warp node values of the second time warp contour portion may be computed starting from the starting node 1665 of the second time warp contour portion on the basis of the warp ratio values of the second time warp contour portion. Later, a third time warp contour portion may start off from a corresponding starting node 1670, which may again take the predetermined staring value independent from any warp ratio values. Accordingly, a periodic restart of the time warp contour portions is obtained. Optionally, a repeated renormalization may be applied, as described in detail above.

Figure 17:
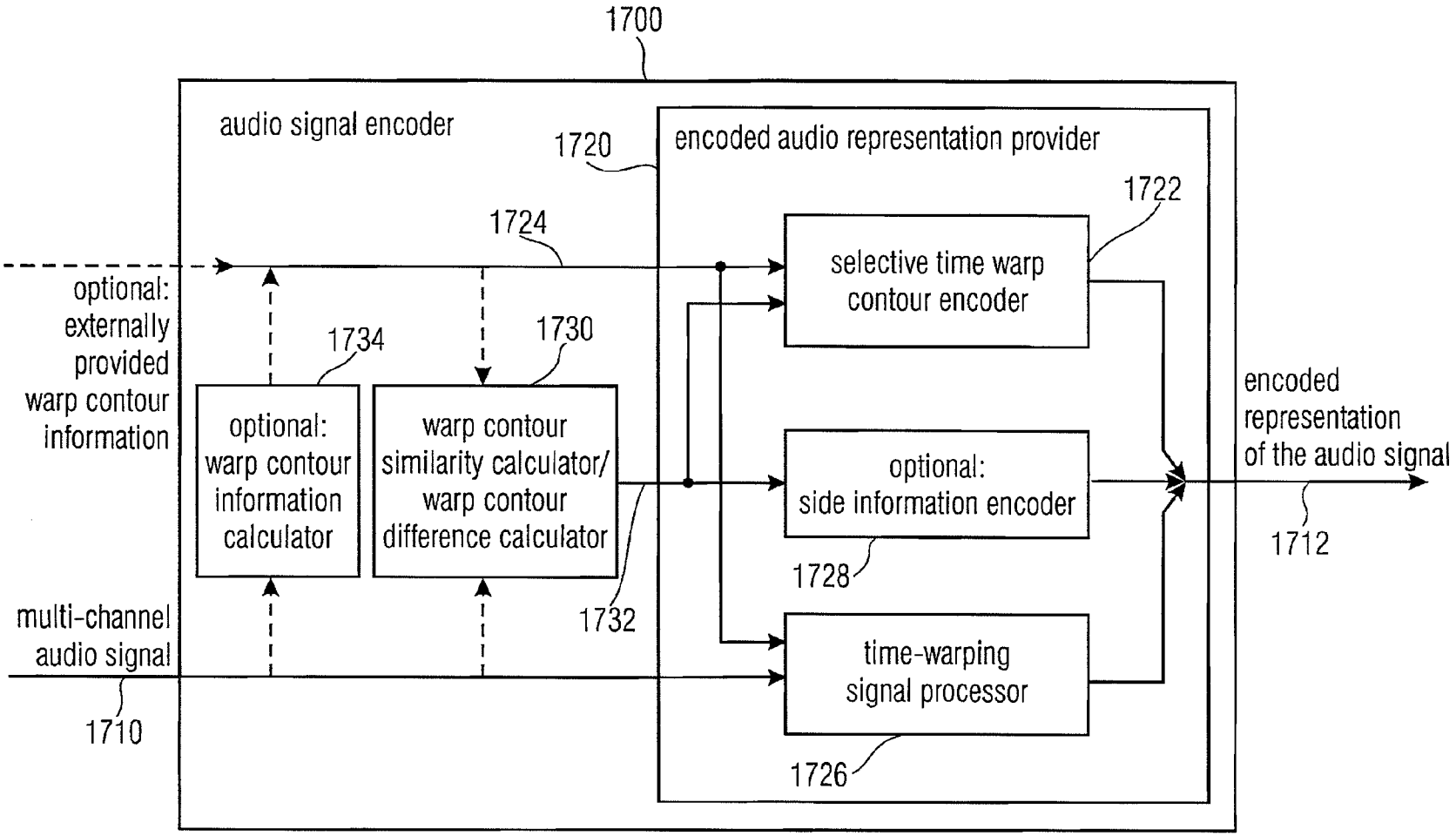
FIG. 17 shows a block schematic diagram of another audio signal encoder, according to an embodiment of the invention.

The Audio Signal Encoder According to FIG. 17

In the following, an audio signal encoder according to another embodiment of the invention will be briefly described, taking reference to FIG. 17. The audio signal encoder 1700 is configured to receive a multi-channel audio signal 1710 and to provide an encoded representation 1712 of the multi-channel audio signal 1710. The audio signal encoder 1700 comprises an encoded audio representation provider 1720, which is configured to selectively provide an audio representation comprising a common warp contour information, commonly associated with a plurality of audio channels of the multi-channel audio signal, or an encoded audio representation comprising individual warp contour information, individually associated with the different audio channels of the plurality of audio channels, dependent on an information describing a similarity or difference between warp contours associated with the audio channels of the plurality of audio channels.

For example, the audio signal encoder 1700 comprises a warp contour similarity calculator or warp contour difference calculator 1730 configured to provide the information 1732 describing the similarity or difference between warp contours associated with the audio channels. The encoded audio representation provider comprises, for example, a selective time warp contour encoder 1722 configured to receive time warp contour information 1724 (which may be externally provided or which may be provided by an optional time warp contour information calculator 1734) and the information 1732. If the information 1732 indicates that the time warp contours of two or more audio channels are sufficiently similar, the selective time warp contour encoder 1722 may be configured to provide a joint encoded time warp contour information. The joint warp contour information may, for example, be based on an average of the warp contour information of two or more channels. However, alternatively the joint warp contour information may be based on a single warp contour information of a single audio channel, but jointly associated with a plurality of channels.

However, if the information 1732 indicates that the warp contours of multiple audio channels are not sufficiently similar, the selective time warp contour encoder 1722 may provide separate encoded information of the different time warp contours.

The encoded audio representation provider 1720 also comprises a time warping signal processor 1726, which is also configured to receive the time warp contour information 1724 and the multi-channel audio signal 1710. The time warping signal processor 1726 is configured to encode the multiple channels of the audio signal 1710. Time warping signal processor 1726 may comprise different modes of operation. For example, the time warping signal processor 1726 may be configured to selectively encode audio channels individually or jointly encode them, exploiting inter-channel similarities. In some cases, it is preferred that the time warping signal processor 1726 is capable of commonly encoding multiple audio channels having a common time warp contour information. There are cases in which a left audio channel and a right audio channel exhibit the same pitch evolution but have otherwise different signal characteristics, e.g. different absolute fundamental frequencies or different spectral envelopes. In this case, it is not desirable to encode the left audio channel and the right audio channel jointly, because of the significant difference between the left audio channel and the right audio channel. Nevertheless, the relative pitch evolution in the left audio channel and the right audio channel may be parallel, such that the application of a common time warp is a very efficient solution. An example of such an audio signal is a polyphone music, wherein contents of multiple audio channels exhibit a significant difference (for example, are dominated by different singers or music instruments), but exhibit similar pitch variation. Thus, coding efficiency can be significantly improved by providing the possibility to have a joint encoding of the time warp contours for multiple audio channels while maintaining the option to separately encode the frequency spectra of the different audio channels for which a common pitch contour information is provided.

The encoded audio representation provider 1720 optionally comprises a side information encoder 1728, which is configured to receive the information 1732 and to provide a side information indicating whether a common encoded warp contour is provided for multiple audio channels or whether individual encoded warp contours are provided for the multiple audio channels. For example, such a side information may be provided in the form of a 1-bit flag named "common_tw".

To summarize, the selective time warp contour encoder 1722 selectively provides individual encoded representations of the time warp audio contours associated with multiple audio signals, or a joint encoded time warp contour representation representing a single joint time warp contour associated with the multiple audio channels. The side information encoder 1728 optionally provides a side information indicating whether individual time warp contour representations or a joint time warp contour representation are provided. The time warping signal processor 1726 provides encoded representations of the multiple audio channels. Optionally, a common encoded information may be provided for multiple audio channels. However, typically it is even possible to provide individual encoded representations of multiple audio channels, for which a common time warp contour representation is available, such that different audio channels having different audio content, but identical time warp are appropriately represented. Consequently, the encoded representation 1712 comprises encoded information provided by the selective time warp contour encoder 1722, and the time warping signal processor 1726 and, optionally, the side information encoder 1728.

Figure 18:
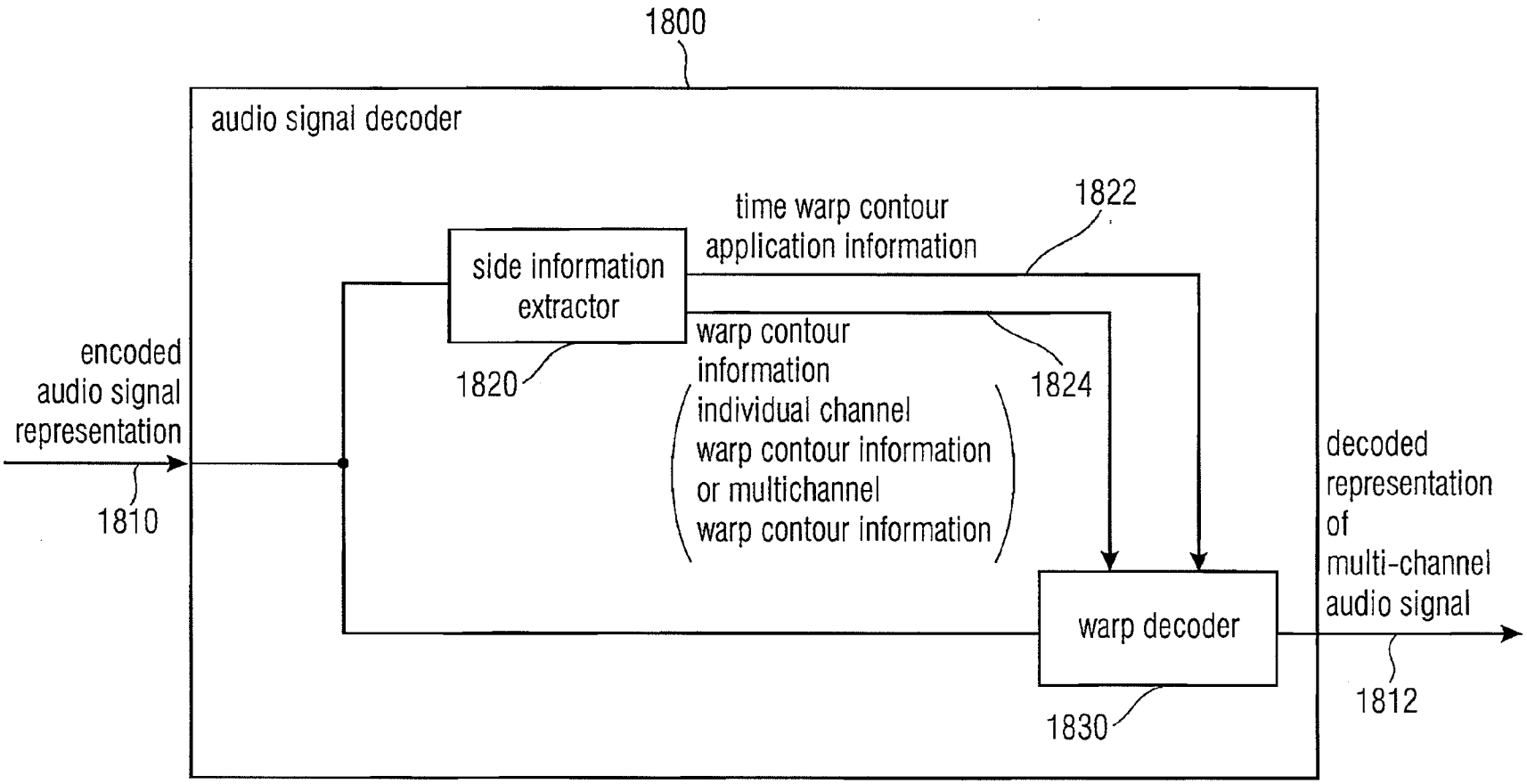
FIG. 18 shows a block schematic diagram of another audio signal decoder, according to an embodiment of the invention.

Audio Signal Decoder According to FIG. 18

FIG. 18 shows a block schematic diagram of an audio signal decoder according to an embodiment of the invention. The audio signal decoder 1800 is configured to receive an encoded audio signal representation 1810 (for example the encoded representation 1712) and to provide, on the basis thereof, a decoded representation 1812 of the multi-channel audio signal. The audio signal decoder 1800 comprises a side information extractor 1820 and a time warp decoder 1830. The side information extractor 1820 is configured to extract a time warp contour application information 1822 and a warp contour information 1824 from the encoded audio signal representation 1810. For example, the side information extractor 1820 may be configured to recognize whether a single, common time warp contour information is available for multiple channels of the encoded audio signal, or whether the separate time warp contour information is available for the multiple channels. Accordingly, the side information extractor may provide both the time warp contour application information 1822 (indicating whether joint or individual time warp contour information is available) and the time warp contour information 1824 (describing a temporal evolution of the common (joint) time warp contour or of the individual time warp contours). The time warp decoder 1830 may be configured to reconstruct the decoded representation of the multi-channel audio signal on the basis of the encoded audio signal representation 1810, taking into consideration the time warp described by the information 1822, 1824. For example, the time warp decoder 1830 may be configured to apply a common time warp contour for decoding different audio channels, for which individual encoded frequency domain information is available. Accordingly, the time warp decoder 1830 may, for example, reconstruct different channels of the multi-channel audio signal, which comprise similar or identical time warp, but different pitch.

Audio Stream According to FIGS. 19*a* to 19*e*

In the following, an audio stream will be described, which comprises an encoded representation of one or more audio signal channels and one or more time warp contours.

FIG. 19*a* shows a graphical representation of a so-called "USAC_raw_data_block" data stream element which may comprise a single channel element (SCE), a channel pair element (CPE) or a combination of one or more single channel elements and/or one or more channel pair elements.

The "USAC_raw_data_block" may typically comprise a block of encoded audio data, while additional time warp contour information may be provided in a separate data stream element. Nevertheless, it is usually possible to encode some time warp contour data into the "USAC_raw_data_block".

As can be seen from FIG. 19*b*, a single channel element typically comprises a frequency domain channel stream ("fd_channel stream"), which will be explained in detail with reference to FIG. 9*d*.

As can be seen from FIG. 19*c*, a channel pair element ("channel_pair_element") typically comprises a plurality of frequency domain channel streams. Also, the channel pair element may comprise time warp information. For example, a time warp activation flag ("tw_MDCT") which may be transmitted in a configuration data stream element or in the "USAC_saw_data_block" determines whether time warp information is included in the channel pair element. For example, if the "tw_MDCT" flag indicates that the time warp is active, the channel pair element may comprise a flag ("common_tw") which indicates whether there is a common time warp for the audio channels of the channel pair element. If said flag (common_tw) indicates that there is a common time warp for multiple of the audio channels, then a common time warp information (tw_data) is included in the channel pair element, for example, separate from the frequency domain channel streams.

Taking reference now to FIG. 19*d*, the frequency domain channel stream is described. As can be seen from FIG. 19*d*, the frequency domain channel stream, for example, comprises a global gain information. Also, the frequency domain channel stream comprises time warp data, if time warping is active (flag "tw_MDCT" active) and if there is no common time warp information for multiple audio signal channel (flag "common_tw" is inactive).

Further, a frequency domain channel stream also comprises scale factor data ("scale_factor_data") and encoded spectral data (for example arithmetically encoded spectral data "ac_spectral_data").

Taking reference now to FIG. 19*e*, the syntax of the time warp data briefly discussed. The time warp data may for example, optionally, comprise a flag (e.g. "tw_data_present" or "active Pitch Data") indicating whether time warp data is present. If the time warp data is present, (i.e. the time warp contour is not flat) the time warp data may comprise a sequence of a plurality of encoded time warp ratio values (e.g. "tw_ratio [i]" or "pitchIdx[i]"), which may, for example, be encoded according to the codebook table of FIG. 9*c*.

Thus, the time warp data may comprise a flag indicating that there is no time warp data available, which may be set by an audio signal encoder, if the time warp contour is constant (time warp ratios are approximately equal to 1.000). In contrast, if the time warp contour is varying, ratios between subsequent time warp contour nodes may be encoded using the codebook indices making up the "tw_ratio" information.

CONCLUSION

Summarizing the above, embodiments according to the invention bring along different improvements in the field of time warping.

The invention aspects described herein are in the context of a time warped MDCT transform coder (see, for example, reference [1]). Embodiments according to the invention provide methods for an improved performance of a time warped MDCT transform coder.

According to an aspect of the invention, a particularly efficient bitstream format is provided. The bitstream format description is based on and enhances the MPEG-2 AAC bitstream syntax (see, for example, reference [2]), but is of course applicable to all bitstream formats with a general description header at the start of a stream and an individual frame-wise information syntax.

For example, the following side information may be transmitted in the bitstream:

In general, a one-bit flag (e.g. named "tw_MDCT") may present in the general audio specific configuration (GASC), indicating if time warping is active or not. Pitch data may be transmitted using the syntax shown in FIG. 19*e* or the syntax shown in FIG. 19*f*. In the syntax shown in FIG. 19*f*, the number of pitches ("numPitches") may be equal to 16, and the number of pitch bits in ("numPitchBits") may be equal to 3. In other words, there may be 16 encoded warp ratio values per time warp contour portion (or per audio signal frame), and each warp contour ratio value may be encoded using 3 bits.

Furthermore, in a single channel element (SCE) the pitch data (pitch_data[ ]) may be located before the section data in the individual channel, if warping is active.

In a channel pair element (CPE), a common pitch flag signals if there is a common pitch data for both channels, which follows after that, if not, the individual pitch contours are found in the individual channels.

In the following, an example will be given for a channel pair element. One example might be a signal of a single harmonic sound source, placed within the stereo panorama. In this case, the relative pitch contours for the first channel and the second channel will be equal or would differ only slightly due to some small errors in the estimation of the variation. In this case, the encoder may decide that instead of sending two separate coded pitch contours for each channel, to send only one pitch contour that is an average of the pitch contours of the first and second channel, and to use the same contour in applying the TW-MDCT on both channels. On the other hand, there might be a signal where the estimation of the pitch contour yields different results for the first and the second channel respectively. In this case, the individually coded pitch contours are sent within the corresponding channel.

In the following, an advantageous decoding of pitch contour data, according to an aspect of the invention, will be described. For example, if the "active PitchData" flag is 0, the pitch contour is set to 1 for all samples in the frame, otherwise the individual pitch contour nodes are computed as follows:

there are numPitches+1 nodes, node [0] is 1.0;

node [i]=node[i−1]·relChange[i] (i=1 . . . numPitches+1), where the relChange is obtained by inverse quantization of the pitchIdx[i].

The pitch contour is then generated by the linear interpolation between the nodes, where the node sample positions are 0:frameLen/numPitches:frameLen.

Implementation Alternatives

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein. Al A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

REFERENCES

[1] L. Villemoes, "Time Warped Transform Coding of Audio Signals", PCT/EP2006/010246, Int. patent application, November 2005

[2] Generic Coding of Moving Pictures and Associated Audio: Advanced Audio Coding. International Standard 13818-7, ISO/IECJTC1/SC29/WG11 Moving Pictures Expert Group, 1997

The invention claimed is:

1. An audio signal decoder configured to provide a decoded audio signal representation on the basis of an encoded audio signal representation comprising a time warp contour evolution information, the audio signal decoder comprising:

a time warp calculator configured to generate time warp contour data repeatedly restarting from a predetermined time warp contour start value on the basis of the time warp contour evolution information describing a temporal evolution of the time warp contour;

a time warp contour rescaler configured to rescale at least a portion of the time warp contour data such that a discontinuity at a restart is avoided, reduced or eliminated in a rescaled version of the time warp contour; and a warp decoder configured to provide the decoded audio signal representation on the basis of the encoded audio signal representation and using the rescaled version of the time warp contour;

wherein the time warp contour rescaler is configured to multiply time warp contour data values with a normalization factor, to scale the portion of the time warp contour, or to divide time warp contour data values by a normalization factor to scale the portion of the time warp contour;

wherein the audio signal decoder is implemented using a hardware apparatus, or using a computer, or using a combination of a hardware apparatus and a computer.

2. The audio signal decoder according to claim 1, wherein the time warp calculator is configured to calculate, starting from the predetermined starting value and using first a relative change information, a temporal evolution of a first portion of the time warp contour, and to calculate, starting from the predetermined starting value and using second relative change information, a temporal evolution of a second portion of the time warp contour, wherein the first portion of the time warp contour and the second portion of the time warp contour are subsequent portions of the time warp contour, and wherein the time warp contour rescaler is configured to rescale one of the portions of the time warp contour, to acquire a steady transition between the first portion of the time warp contour and the second portion of the time warp contour.

3. The audio signal decoder according to claim 2, wherein the time warp contour rescaler is configured to rescale the first portion of the time warp contour such that a last value of the scaled version of the first time warp contour portion takes the predetermined starting value or deviates from the predetermined starting value by no more than a predetermined tolerance value.

4. The audio signal decoder according to claim 1, wherein the time warp calculator is configured to acquire a warp contour sum value of a given portion of the time warp contour, and to scale the given portion of the time warp contour and the warp contour sum value of the given portion of the time warp contour using a common scaling value.

5. The audio signal decoder according to claim 1, wherein the audio signal decoder comprises a time warp control information calculator configured to calculate a time warp control information using a plurality of portions of the time warp contour, wherein the time warp control information calculator is configured to calculate a time warp control information for a reconstruction of a first frame of the audio signal on the basis of time warp contour data of a first plurality of time warp contour portions, and to calculate a time warp control information for a reconstruction of a second frame of the audio signal, which is overlapping or non-overlapping with the first frame of the audio signal, on the basis of time warp contour data of a second plurality of time warp contour portions, wherein the first plurality of time warp contour portions is shifted, with respect to time, when compared to the second plurality of time warp contour portions, and wherein the first plurality of time warp contour portions comprises at least one common time warp contour portion with the second plurality of time warp contour portions.

6. The audio signal decoder according to claim 5, wherein the time warp calculator is configured to generate the time warp contour such that the time warp contour restarts from the predetermined time warp contour start value at a position within the first plurality of time warp contour portions, or at a position within the second plurality of time warp contour portions, such that there is a discontinuity of the time warp contour at the location of the restart; and wherein the time warp contour rescaler is configured to rescale one or more of the time warp contour portions, such that the discontinuity is reduced or eliminated.

7. The audio signal decoder according to claim 6, wherein the time warp calculator is configured to generate the time warp contour such that there is a first restart of the time warp contour from the predetermined time warp contour start value at a position within the first plurality of time warp contour portions, such that there is a first discontinuity at the position of the first restart, wherein the time warp contour rescaler is configured to rescale the time warp contour such that the first discontinuity is reduced, wherein the time warp calculator is configured to also generate the time warp contour such that there is a second restart of the time warp contour from the predetermined time warp contour start value at a position within the second plurality of time warp contour portions, such that there is a second discontinuity at the position of the second restart; and wherein the time warp contour rescaler is configured to also rescale the time warp contour such that the second discontinuity is reduced or eliminated.

8. The audio signal decoder according to claim 1, wherein the time warp calculator is configured to periodically restart the time warp contour starting from the predetermined time warp contour start value, such that there are periodic discontinuities at the restarts;

wherein the time warp contour rescaler is adapted to successively rescale at least one portion of the time warp contour at any one time, to reduce successively or eliminate the discontinuities of the time warp contour at the restarts; and wherein the audio signal decoder comprises a time warp control information calculator configured to combine time warp contour data from before and after the restart to acquire a time warp control information.

9. An audio signal decoder configured to provide a decoded audio signal representation on the basis of an encoded audio signal representation comprising a time warp contour evolution information, the audio signal decoder comprising:

a time warp calculator configured to generate time warp contour data repeatedly restarting from a predetermined time warp contour start value on the basis of the time warp contour evolution information describing a temporal evolution of the time warp contour;

a time warp contour rescaler configured to rescale at least a portion of the time warp contour data such that a discontinuity at a restart is avoided, reduced or eliminated in a rescaled version of the time warp contour; and a warp decoder configured to provide the decoded audio signal representation on the basis of the encoded audio signal representation and using the rescaled version of the time warp contour, wherein the audio signal decoder further comprises a time contour calculator configured to calculate a first time contour using time warp contour data values of a first portion of the time warp contour, of a second portion of the time warp contour and of a third portion of the time warp contour, and to calculate a second time contour using time warp contour data values of the second portion of the time warp contour, of the third portion of the time warp contour and of a fourth portion of the time warp contour;

wherein the time warp calculator is configured to generate time warp contour data of the first portion of the time warp contour starting from a predetermined time warp contour start value on the basis of a time warp contour evolution information describing a temporal evolution of the first portion of the time warp contour;

wherein the time warp contour rescaler is configured to rescale the first portion of the time warp contour such that a last value of the first portion of the time warp contour comprises the predetermined time warp contour start value;

wherein the time warp calculator is configured to generate warp contour data of the second portion of the time warp contour starting from the predetermined time warp contour start value on the basis of a time warp contour evolution information describing a temporal evolution of the second portion of the time warp contour;

wherein the time warp contour rescaler is configured to jointly rescale the first portion of the time warp contour and the second portion of the time warp contour using a common scaling factor, such that a last value of the second portion of the time warp contour comprises the predetermined time warp contour start value, to acquire jointly a rescaled time warp contour data values;

wherein the time warp calculator is configured to generate original time warp contour data values of the third portion of the time warp contour starting from the predetermined time warp contour start value, on the basis of a time warp contour evolution information of the third portion of the time warp contour;

wherein the time contour calculator is configured to calculate the first time contour using the jointly rescaled time warp contour data values of the first and second time warp contour portions and the time warp contour data values of the third time warp contour portion;

wherein the time warp contour rescaler is configured to jointly rescale time warp contour data values of the second, rescaled portion of the time warp contour and of the third portion of the time warp contour using another common scaling factor, such that a last value of the third portion of the time warp contour comprises the predetermined time warp contour start value, to acquire a twice rescaled version of the second portion of the time warp contour and a once rescaled version of the third portion of the time warp contour;

wherein the time warp calculator is configured to generate original time warp contour data values of the fourth portion of the time warp contour starting from the predetermined time warp contour start value on the basis of a time warp contour evolution information of the fourth portion of the time warp contour; and wherein the time contour calculator is configured to calculate the second time contour using the twice rescaled version of the second portion of the time warp contour, the once rescaled version of the third portion of the time warp contour and the original version of the fourth portion of the time warp contour;

wherein the audio signal decoder is implemented using a hardware apparatus, or using a computer, or using a combination of a hardware apparatus and a computer.

10. An audio signal decoder configured to provide a decoded audio signal representation on the basis of an encoded audio signal representation comprising a time warp contour evolution information, the audio signal decoder comprising:

a time warp calculator configured to generate time warp contour data repeatedly restarting from a predetermined time warp contour start value on the basis of the time warp contour evolution information describing a temporal evolution of the time warp contour;

a time warp contour rescaler configured to rescale at least a portion of the time warp contour data such that a discontinuity at a restart is avoided, reduced or eliminated in a rescaled version of the time warp contour; and a warp decoder configured to provide the decoded audio signal representation on the basis of the encoded audio signal representation and using the rescaled version of the time warp contour, wherein the time warp calculator is configured to receive an encoded warp ratio information, to derive a sequence of time warp ratio values from the encoded time warp ratio information, and to acquire time warp contour node values starting from the time warp contour start value;

wherein ratios between the time warp contour starting value associated with a time warp contour starting node and the time warp contour node values of subsequent time warp contour nodes are determined by the time warp ratio values:

wherein the time warp calculator is configured to compute a time warp contour node value of a given time warp contour node, which is spaced from the time warp contour starting node by an intermediate time warp contour node, on the basis of a product-formation comprising a ratio between the time warp contour starting value and the time warp contour node value of the intermediate time warp contour node and a ratio between the time warp contour node value of the intermediate time warp contour node and the time warp contour node value of the given time warp contour node as factors;

wherein the audio signal decoder is implemented using a hardware apparatus, or using a computer, or using a combination of a hardware apparatus and a computer.

11. A method for providing a decoded audio signal representation on the basis of an encoded audio signal representation comprising a time warp contour evolution information, the method comprising:

generating time warp contour data repeatedly restarting from a predetermined time warp contour start value on the basis of a time warp contour evolution information describing a temporal evolution of the time warp contour;

rescaling at least a portion of the time warp contour data, such that a discontinuity at a restart is avoided, reduced or eliminated in a rescaled version of the time warp contour; and providing the decoded audio signal representation on the basis of the encoded audio signal representation and using the rescaled version of the time warp contour, wherein the method comprises multiplying time warp contour data values with a normalization factor, to scale the portion of the time warp contour, or dividing time warp contour data values by a normalization factor to scale the portion of the time warp contour.

12. A non-transitory computer-readable medium having program code stored thereon, wherein the program code, when executed by a computer, performs the method according to claim 11.

13. A time warp contour data provider for providing time warp contour data representing a temporal evolution of a relative pitch of an audio signal on the basis of a time warp contour evolution information, the time warp contour data provider comprising:

a time warp calculator configured to generate time warp contour data on the basis of a time warp contour evolution information describing a temporal evolution of the time warp contour, wherein the time warp calculator is configured to repeatedly or periodically restart, at a restart position, a calculation of the time warp contour data from a predetermined time warp contour start value, thereby creating discontinuities of the time warp contour and reducing a range of the time warp contour data values; and a time warp contour rescaler configured to repeatedly rescale portions of the time warp contour, to reduce or eliminate the discontinuities at the restart positions in rescaled sections of the time warp contour;

wherein the time warp contour rescaler is configured to multiply time warp contour data values with a normalization factor, to scale the portion of the time warp contour, or to divide time warp contour data values by a normalization factor to scale the portion of the time warp contour;

wherein the time warp contour data provider is implemented using a hardware apparatus, or using a computer, or using a combination of a hardware apparatus and a computer.

14. A method for providing a decoded audio signal representation on the basis of an encoded audio signal representation comprising a time warp contour evolution information, the method comprising:

generating time warp contour data repeatedly restarting from a predetermined time warp contour start value on the basis of a time warp contour evolution information describing a temporal evolution of the time warp contour;

rescaling at least a portion of the time warp contour data, such that a discontinuity at a restart is avoided, reduced or eliminated in a rescaled version of the time warp contour; and providing the decoded audio signal representation on the basis of the encoded audio signal representation and using the rescaled version of the time warp contour;

wherein the method comprises calculating a first time contour using time warp contour data values of a first portion of the time warp contour, of a second portion of the time warp contour and of a third portion of the time warp contour, and calculating a second time contour using time warp contour data values of the second portion of the time warp contour, of the third portion of the time warp contour and of a fourth portion of the time warp contour;

wherein the method comprises generating time warp contour data of the first portion of the time warp contour starting from a predetermined time warp contour start value on the basis of a time warp contour evolution information describing a temporal evolution of the first portion of the time warp contour;

wherein the method comprises rescaling the first portion of the time warp contour such that a last value of the first portion of the time warp contour comprises the predetermined time warp contour start value;

wherein the method comprises generating warp contour data of the second portion of the time warp contour starting from the predetermined time warp contour start value on the basis of a time warp contour evolution information describing a temporal evolution of the second portion of the time warp contour;

wherein the method comprises jointly rescaling the first portion of the time warp contour and the second portion of the time warp contour using a common scaling factor, such that a last value of the second portion of the time warp contour comprises the predetermined time warp contour start value, to acquire jointly a rescaled time warp contour data values;

wherein the method comprises generating original time warp contour data values of the third portion of the time warp contour starting from the predetermined time warp contour start value, on the basis of a time warp contour evolution information of the third portion of the time warp contour;

wherein the method comprises calculating the first time contour using the jointly rescaled time warp contour data values of the first and second time warp contour portions and the time warp contour data values of the third time warp contour portion;

wherein the method comprises jointly rescaling time warp contour data values of the second, rescaled portion of the time warp contour and of the third portion of the time warp contour using another common scaling factor, such that a last value of the third portion of the time warp contour comprises the predetermined time warp contour start value, to acquire a twice rescaled version of the second portion of the time warp contour and a once rescaled version of the third portion of the time warp contour;

wherein the method comprises generating original time warp contour data values of the fourth portion of the time warp contour starting from the predetermined time warp contour start value on the basis of a time warp contour evolution information of the fourth portion of the time warp contour; and wherein the method comprises calculating the second time contour using the twice rescaled version of the second portion of the time warp contour, the once rescaled version of the third portion of the time warp contour and the original version of the fourth portion of the time warp contour.

15. A non-transitory computer-readable medium having program code stored thereon, wherein the program code, when executed by a computer, performs the method according to claim 14.

16. A method for providing a decoded audio signal representation on the basis of an encoded audio signal representation comprising a time warp contour evolution information, the method comprising:

generating time warp contour data repeatedly restarting from a predetermined time warp contour start value on the basis of a time warp contour evolution information describing a temporal evolution of the time warp contour;

rescaling at least a portion of the time warp contour data, such that a discontinuity at a restart is avoided, reduced or eliminated in a rescaled version of the time warp contour; and providing the decoded audio signal representation on the basis of the encoded audio signal representation and using the rescaled version of the time warp contour;

wherein the method comprises receiving an encoded warp ratio information, deriving a sequence of time warp ratio values from the encoded time warp ratio information, and acquiring time warp contour node values starting from the time warp contour start value;

wherein ratios between the time warp contour starting value associated with a time warp contour starting node and the time warp contour node values of subsequent time warp contour nodes are determined by the time warp ratio values;

wherein the method comprises computing a time warp contour node value of a given time warp contour node, which is spaced from the time warp contour starting node by an intermediate time warp contour node, on the basis of a product-formation comprising a ratio between the time warp contour starting value and the time warp contour node value of the intermediate time warp contour node and a ratio between the time warp contour node value of the intermediate time warp contour node and the time warp contour node value of the given time warp contour node as factors.

17. A non-transitory computer-readable medium having program code stored thereon, wherein the program code, when executed by a computer, performs the method according to claim 16.

* * * * *